US009149128B2

(12) United States Patent
Rampton et al.

(10) Patent No.: US 9,149,128 B2
(45) Date of Patent: Oct. 6, 2015

(54) PLAY YARD WITH REMOVABLE LINER

(75) Inventors: Kurt Russell Rampton, Charlotte, NC (US); Edgar Montague, Charlotte, NC (US); Robert Gibson, Charlotte, NC (US); Steve Burns, Cumming, GA (US); John Matthew Thomson, Johns Creek, GA (US)

(73) Assignee: Kids II, Inc., Atlanta, GA (US)

( * ) Notice: Subject to any disclaimer, the term of this patent is extended or adjusted under 35 U.S.C. 154(b) by 560 days.

(21) Appl. No.: 13/034,313

(22) Filed: Feb. 24, 2011

(65) Prior Publication Data

US 2012/0216346 A1 Aug. 30, 2012

(51) Int. Cl.
*A47D 13/06* (2006.01)
*A47D 7/00* (2006.01)

(52) U.S. Cl.
CPC ..... *A47D 13/063* (2013.01); *A47D 13/061* (2013.01); *A47D 13/066* (2013.01); *A47D 7/002* (2013.01)

(58) Field of Classification Search
CPC ..... A47D 7/00; A47D 7/002; A47D 7/01; A47D 7/03; A47D 7/04; A47D 9/00; A47D 9/005; A47D 13/06; A47D 13/061; A47D 13/063
USPC ..... 5/99.1, 93.1, 93.2, 98.1, 655
See application file for complete search history.

(56) References Cited

U.S. PATENT DOCUMENTS

| | | | | |
|---|---|---|---|---|
| 548,901 | A | 10/1895 | Welch | |
| 914,104 | A * | 3/1909 | Binney | 5/97 |
| 914,309 | A | 3/1909 | Ross | |
| 1,183,819 | A | 5/1916 | Keiser | |
| 2,486,054 | A * | 10/1949 | Morse | 5/99.1 |
| 2,698,443 | A * | 1/1955 | Ralick | 5/99.1 |
| 3,165,760 | A | 1/1965 | Abajian | |
| 3,358,725 | A | 12/1967 | Bussard et al. | |
| 3,875,623 | A | 4/1975 | Johnston | |
| 4,538,309 | A | 9/1985 | Gunter | |
| 4,811,437 | A | 3/1989 | Dillner et al. | |
| 4,899,496 | A | 2/1990 | Chew, II | |
| 4,967,432 | A * | 11/1990 | Kujawski et al. | 5/98.1 |
| 4,985,948 | A | 1/1991 | Mariol | |

(Continued)

FOREIGN PATENT DOCUMENTS

| | | | |
|---|---|---|---|
| AU | 715883 | B3 | 2/2000 |
| AU | 2008101208 | A4 | 1/2009 |

(Continued)

OTHER PUBLICATIONS

United States Patent and Trademark Office, Office Action for U.S. Appl. No. 13/182,138, dated Nov. 21, 2012, 19 pages, USA.

(Continued)

*Primary Examiner* — Robert G Santos
(74) *Attorney, Agent, or Firm* — Alston & Bird LLP

(57) ABSTRACT

Various embodiments of the present invention are directed to a play yard configured for providing an enclosed space for a child. According to various embodiments, the play yard comprises a rigid support frame and removable, flexible liner. The frame includes one or more moveable retention members configured to engage the liner in order to form a bounded play yard space. By permitting the liner to be secured to the frame via the retention members, a user is able to easily secure the liner to the frame for use and remove the liner from the frame for washing.

20 Claims, 17 Drawing Sheets

(56) References Cited

U.S. PATENT DOCUMENTS

| | | | | |
|---|---|---|---|---|
| 5,140,718 | A | 8/1992 | Toth | |
| 5,163,191 | A | 11/1992 | Chan | |
| 5,241,716 | A * | 9/1993 | Kohus | 5/99.1 |
| 5,279,006 | A | 1/1994 | Teng | |
| 5,339,470 | A | 8/1994 | Shamie | |
| 5,349,709 | A | 9/1994 | Cheng | |
| 5,414,873 | A | 5/1995 | Wolf | |
| 5,450,703 | A | 9/1995 | Fuhrman et al. | |
| 5,526,542 | A | 6/1996 | Huang | |
| 5,553,336 | A | 9/1996 | Mariol | |
| 5,615,427 | A * | 4/1997 | Huang | 5/99.1 |
| 5,727,265 | A | 3/1998 | Ziegler et al. | |
| 5,752,297 | A | 5/1998 | Ramey | |
| 5,778,465 | A | 7/1998 | Myers | |
| 5,806,112 | A | 9/1998 | Harms | |
| 5,845,349 | A | 12/1998 | Tharalson et al. | |
| 5,867,850 | A | 2/1999 | Mariol | |
| 5,991,944 | A * | 11/1999 | Yang | 5/99.1 |
| 5,992,348 | A | 11/1999 | Harding | |
| 6,041,455 | A | 3/2000 | Raffo et al. | |
| 6,067,676 | A | 5/2000 | Carnahan et al. | |
| 6,131,218 | A * | 10/2000 | Wang | 5/93.1 |
| 6,148,456 | A * | 11/2000 | Tharalson et al. | 5/99.1 |
| 6,192,535 | B1 | 2/2001 | Warner, Jr. et al. | |
| 6,233,759 | B1 * | 5/2001 | Warner et al. | 5/99.1 |
| 6,256,814 | B1 | 7/2001 | Drobinski | |
| 6,430,762 | B1 * | 8/2002 | Cheng | 5/93.2 |
| 6,434,767 | B1 * | 8/2002 | Welsh, Jr. | 5/93.2 |
| 6,510,570 | B2 | 1/2003 | Hartenstine et al. | |
| 6,539,563 | B1 * | 4/2003 | Hsia | 5/93.2 |
| 6,578,211 | B2 | 6/2003 | Tharalson et al. | |
| 6,634,038 | B2 * | 10/2003 | Hsia | 5/95 |
| 6,687,927 | B1 | 2/2004 | Tharalson et al. | |
| 6,735,796 | B2 * | 5/2004 | Warner et al. | 5/99.1 |
| 6,859,957 | B1 | 3/2005 | Chen | |
| 6,859,958 | B2 | 3/2005 | LaMantia | |
| 6,874,177 | B2 * | 4/2005 | Hsia | 5/93.1 |
| 6,895,611 | B2 | 5/2005 | Tharalson et al. | |
| 6,901,613 | B1 * | 6/2005 | Hsia | 5/93.1 |
| 7,013,505 | B2 | 3/2006 | Martin | |
| 7,043,779 | B2 | 5/2006 | Mendenhall et al. | |
| 7,055,191 | B1 * | 6/2006 | Chen | 5/93.2 |
| 7,090,201 | B2 | 8/2006 | Brucker | |
| 7,401,366 | B1 | 7/2008 | Costa | |
| 7,526,821 | B2 | 5/2009 | Chen et al. | |
| 7,568,242 | B2 | 8/2009 | Troutman | |
| 7,739,759 | B2 * | 6/2010 | Mendes et al. | 5/93.1 |
| 7,752,688 | B2 | 7/2010 | Chen et al. | |
| 7,770,245 | B2 | 8/2010 | Cheng et al. | |
| 7,882,579 | B2 * | 2/2011 | Jackson et al. | 5/93.1 |
| 7,958,578 | B2 * | 6/2011 | Shan et al. | 5/93.1 |
| 8,141,186 | B2 * | 3/2012 | Burns et al. | 5/98.1 |
| 8,201,291 | B2 * | 6/2012 | Burns et al. | 5/93.2 |
| D672,988 | S * | 12/2012 | Suvak et al. | D6/718 |
| RE43,919 | E * | 1/2013 | Chen | 5/93.1 |
| 8,490,227 | B2 * | 7/2013 | Troutman | 5/99.1 |
| D699,063 | S * | 2/2014 | Stitchick et al. | D6/718 |
| 8,640,278 | B2 * | 2/2014 | You et al. | 5/11 |
| 8,656,530 | B2 * | 2/2014 | You et al. | 5/93.2 |
| 8,955,174 | B1 * | 2/2015 | Lawlor et al. | 5/93.1 |
| 2001/0001161 | A1 * | 5/2001 | Warner et al. | 5/99.1 |
| 2001/0001162 | A1 * | 5/2001 | Warner et al. | 5/99.1 |
| 2001/0001330 | A1 * | 5/2001 | Warner et al. | 5/99.1 |
| 2002/0078499 | A1 * | 6/2002 | Cheng | 5/95 |
| 2002/0092094 | A1 * | 7/2002 | Welsh, Jr. | 5/95 |
| 2003/0070229 | A1 * | 4/2003 | Hsia | 5/95 |
| 2003/0070230 | A1 * | 4/2003 | Hsia | 5/95 |
| 2003/0154547 | A1 | 8/2003 | Hsia | |
| 2003/0177575 | A1 | 9/2003 | Cheng et al. | |
| 2004/0187207 | A1 | 9/2004 | Hsia | |
| 2005/0262629 | A1 | 12/2005 | Cheng et al. | |
| 2006/0021138 | A1 | 2/2006 | Waldman et al. | |
| 2006/0185082 | A1 * | 8/2006 | Casati Troutman | 5/99.1 |
| 2006/0230528 | A1 | 10/2006 | Church | |
| 2008/0271244 | A1 | 11/2008 | Bergkvist | |
| 2009/0077738 | A1 * | 3/2009 | Burns et al. | 5/93.1 |
| 2009/0077739 | A1 * | 3/2009 | Mendes et al. | 5/93.1 |
| 2009/0077740 | A1 * | 3/2009 | Jackson et al. | 5/93.1 |
| 2009/0077741 | A1 * | 3/2009 | Burns et al. | 5/93.2 |
| 2009/0133190 | A1 * | 5/2009 | Chen et al. | 5/93.1 |
| 2009/0188039 | A1 * | 7/2009 | Shan et al. | 5/93.1 |
| 2009/0260155 | A1 | 10/2009 | Troutman | |
| 2010/0132115 | A1 | 6/2010 | Hsu | |
| 2012/0042447 | A1 * | 2/2012 | You et al. | 5/11 |
| 2012/0211713 | A1 * | 8/2012 | You et al. | 256/25 |
| 2012/0216346 | A1 * | 8/2012 | Rampton et al. | 5/99.1 |
| 2014/0068857 | A1 * | 3/2014 | Jackson et al. | 5/98.1 |

FOREIGN PATENT DOCUMENTS

| | | |
|---|---|---|
| CN | 201 104 680 | 8/2008 |
| CN | 201 213 630 | 4/2009 |
| DE | 202008016861 U1 | 4/2009 |
| EP | 0144165 A1 | 6/1985 |
| EP | 1712160 A1 | 10/2006 |

OTHER PUBLICATIONS

International Search Report and Written Opinion of International Searching Authority dated Nov. 2, 2011 for corresponding Application No. PCT/US2011/041717.

International Preliminary Examining Authority, Written Opinion (second) for International Application No. PCT/US2011/041717, mailed Feb. 19, 2013, 7 pages, European Patent Office, The Netherlands.

International Preliminary Examining Authority, International Preliminary Report on Patentability, including Applicant's Dec. 21, 2012 Amendments Under Article 34 and Response to Written Opinion on Preliminary Examination, for International Application No. PCT/US2011/041717, mailed May 31, 2013, 44 pages, European Patent Office, The Netherlands.

IP Australia, Australian Government, Examination Report No. 1 for Application No. 2011279242, Mar. 25, 2014, 4 pages, Australia.

European Patent Office, Communication pursuant to Article 94(3) EPC for Application No. 11729019.7, Oct. 20, 2014, 7 pages, The Netherlands.

* cited by examiner

PLAY YARD WITH REMOVABLE LINER

BACKGROUND OF THE INVENTION

A play yard is a containment device often used for providing a partially enclosed space for a child. Typically, play yards include a rigid frame having upper and lower horizontal frame members joined by vertical frame members. A floor panel and sidewalls are usually defined in between the frame members along with an upper opening through which a child may be moved in and out of the play yard. The sidewalls and floor panel are often comprised of a fabric material disposed over the frame members. In addition, the frame members may be collapsible to allow for easier portability and storage of the play yard.

In many play yards, the sidewalls and floor panel of the play yard are formed from a non-removable fabric material design to collapse with the play yard frame. For example, the foldable play yard described in U.S. Pat. No. 4,811,437 includes side panels made from a flexible material and having laterally and vertically oriented sleeves connecting the side panels to a foldable play yard frame. The flexible side panels of the '437 patent, however, are not easily removable from the play yard after the play yard is assembled, thereby rending the panels difficult to wash or clean.

More recent play yards provide a removable fabric enclosure that may be secured to a play yard frame in order to form surrounding sidewalls. For example, U.S. Pat. No. 6,859,957 and U.S. Pat. No. 7,568,242 disclose play yards including a removable fabric enclosure having vertical posts positioned at corners of the enclosure. The vertical posts of the enclosure are configured to be inserted into vertical tubes disposed on a play yard frame, thereby permitting the enclosure to be removably secured to the play yard frame. However, enclosures having such posts can often be difficult to secure to a corresponding frame, easily damaged and rendered unusable, and damaging to machine washers.

Accordingly, there remains a need in the art for an improved play yard having a removable, washable liner that is durable and easily secured to and removed from a play yard frame.

BRIEF SUMMARY OF THE INVENTION

Various embodiments of the present invention are directed to a children's play yard. According to various embodiments, the play yard comprises a play yard frame and a removable play yard liner. The play yard frame comprises one or more lower horizontal frame members; one or more vertical frame members attached to the lower horizontal frame members, wherein at least a portion of the vertical frame members extends upwardly from the lower horizontal frame members; and one or more movable retention members operatively connected to the vertical frame members and configured to move between an inward receiving orientation and a retaining orientation. The removable play yard liner comprises one or more sidewalls; and one or more sleeves defined vertically along the sidewalls, the sleeves configured to slide over the moveable retention members. The sidewalls of the play yard liner extend between the retention members of the play yard frame and define a bounded area within the play yard when the vertical sleeves are positioned over the retention members and the retention members are positioned in the retaining orientation.

In addition, according to various embodiments, a method for securing a removable play yard liner to a play yard frame is provided comprising the steps of setting up a play yard frame to have one or more vertical frame members and one or more retention members; orienting the one or more retention members from a retaining orientation to a receiving orientation inward from the one more vertical frame members; orienting a play yard liner having one or more sidewalls and one or more sleeves such that the sleeves are generally adjacent one or more respective retention members; sliding the one or more sleeves over the retention members; and reorienting the one or more retention members to the retaining orientation such that the sidewalls of the play yard liner extend between the retention members of the play yard frame and define a bounded area within the play yard.

In addition, according to other embodiments, a children's play yard comprises a play yard frame comprising one or more lower horizontal frame members; one or more vertical frame members attached to the lower horizontal frame members; and one or more upper horizontal frame members defining an upper perimeter of the play yard, wherein the upper horizontal frame members are configured to be removably secured to upper ends of the vertical frame members thereby permitting the upper horizontal frame members to be removed from the play yard frame. The play yard further comprises a removable play yard liner comprising one or more sidewalls, and one or more sleeves disposed vertically along the sidewalls, the sleeves configured to slide over the vertical frame members. The sidewalls of the play yard liner extend between the vertical frame members of the play yard frame and define a bounded area within the play yard when the vertical sleeves are positioned over the vertical frame members. In addition, the one or more upper horizontal frame members may comprise a plurality of upper horizontal frame members connected by joint members disposed between adjacent upper horizontal frame members; and the joint members are configured to be removably secured to upper ends of the one or more vertical frame members thereby permitting the upper horizontal frame members and the joint members to be removed from the play yard frame.

In addition, according to other embodiments, a children's play yard comprises a play yard frame comprising one or more lower horizontal frame members; one or more vertical frame members attached to the lower horizontal frame members, wherein at least a portion of the vertical frame members extends upwardly from the lower horizontal frame members; and one or more movable retention members operatively connected to the vertical frame members and configured to move between a receiving orientation and a retaining orientation. The play yard further comprises a removable play yard liner comprising one or more sidewalls and one or more engagement features configured to engage the one or more moveable retention members. The sidewalls of the play yard liner extend between the moveable retention members of the play yard frame and define a bounded area within the play yard when the engagement features are engaged with the retention members and the retention members are positioned in the retaining orientation.

In addition, according to other embodiments, a children's play yard comprises a play yard frame comprising one or more lower horizontal frame members; one or more vertical frame members attached to the lower horizontal frame members, wherein at least a portion of the vertical frame members extends upwardly from the lower horizontal frame members; and one or more retention members operatively connected to the vertical frame members. In addition, the play yard further comprises a removable play yard liner comprising one or more sidewalls and one or more engagement features configured to engage the one or more retention members. The sidewalls of the play yard liner extend between the moveable retention members of the play yard frame and define a bounded area within the play yard when the engagement features are engaged with the retention members.

BRIEF DESCRIPTION OF THE SEVERAL VIEWS OF THE DRAWING(S)

Reference will now be made to the accompanying drawings, which are not necessarily drawn to scale, and wherein.

DETAILED DESCRIPTION OF THE INVENTION

The present inventions will now be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Various embodiments of the present invention are directed to a play yard configured for providing an enclosed space for a child. According to various embodiments, the play yard is generally comprised of a frame and removable liner. Generally, the play yard frame is a substantially rigid structure configured for receiving and supporting the removable liner, which may be constructed from a flexible, washable material. When secured to the frame, the removable liner defines a partially enclosed space dimensioned for receiving a child.

Play Yard Frame

Figure 1:
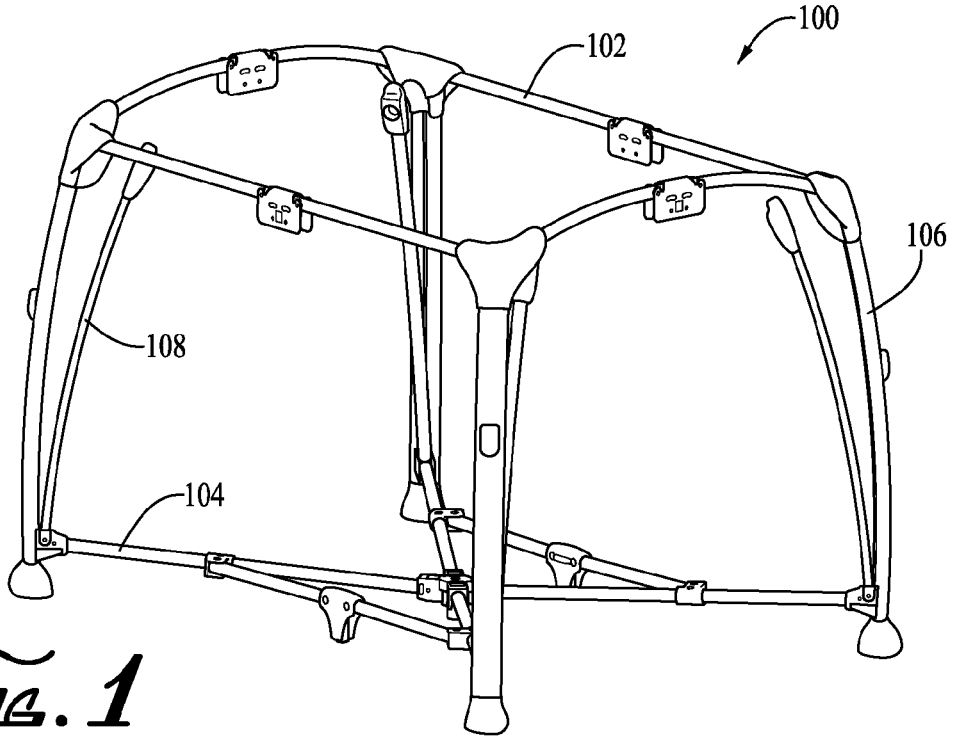
FIG. 1 shows a perspective view of a play yard frame according to one embodiment of the present invention.

FIG. 1 illustrates a play yard frame 100 according to one embodiment. In the illustrated embodiment, the frame 100 includes a plurality of upper horizontal frame members 102, a plurality of lower horizontal frame members 104, and four vertical frame members 106. As shown, the vertical frame members 106 are positioned at the corners of the frame 100 and include feet configured to rest on a floor or support surface. The upper horizontal frame members 102 and lower horizontal frame members 104 are connected at different heights to the vertical frame members 106 such that they are vertically spaced from one another. The upper horizontal frame members 102 extend between adjacent vertical frame members 106, thereby forming an upper perimeter of the frame 100. The lower horizontal frame members 104 are positioned inwardly from the vertical frame members 106 and are connected to one another at various points to form a lower support surface spaced above the floor (or other support surface upon which the frame 100 is positioned). The terms "horizontal" and "vertical" are used herein to indicate components that are generally horizontally or vertically oriented with respect to a floor (or other support surface) and are not intended to indicate that particular components must be strictly or entirely horizontal or vertical.

Figure 2:
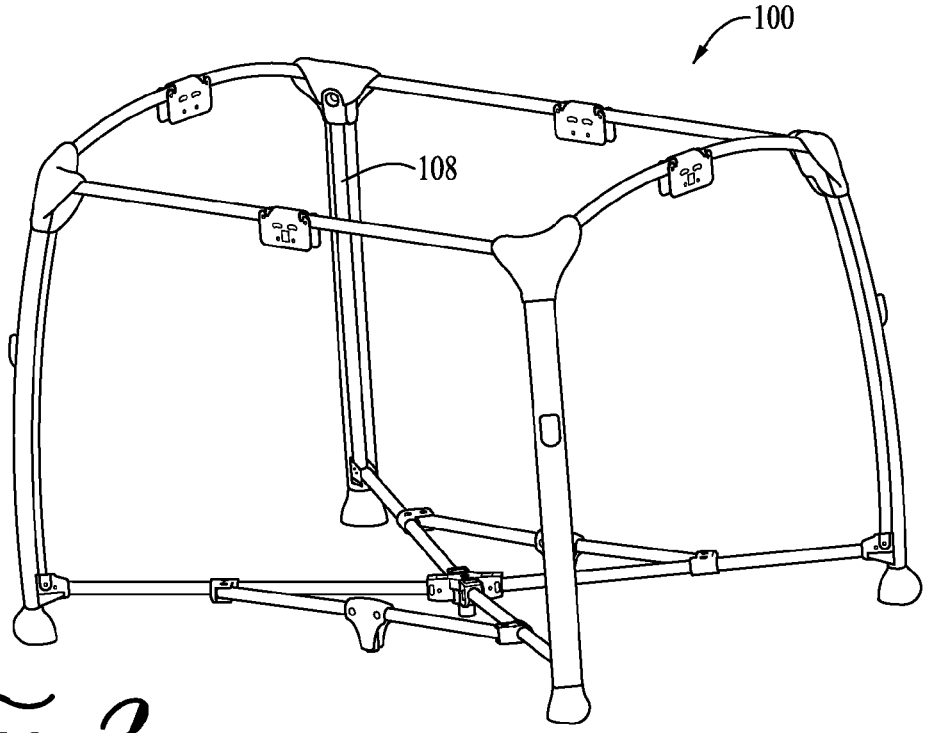
FIG. 2 shows another perspective view of the play yard frame of FIG. 1.

The frame 100 also includes four retention members 108, each of which is operatively connected to a respective vertical member 106. The retention members 108 are generally elongate members capable of moving between an inward receiving orientation and a retaining orientation. For example, FIG. 1 illustrates the frame 100 with the retention members 108 positioned in an inward receiving orientation according to one embodiment. In the illustrated embodiment, the inward receiving orientation is one in which the retention members 108 are tilted slightly inward toward the center of the frame 100. As described in greater detail herein, the inward receiving orientation permits a removable play yard liner to be easily secured to the frame 100 by sliding sleeves of the liner over each of the retention members 108. FIG. 2 illustrates the frame 100 with the retention members 108 positioned in a retaining orientation according to one embodiment. In the illustrated embodiment, the retaining orientation is one in which the retention members 108 are vertically oriented and generally parallel with the vertical frame members 106. As described in greater detail herein, the retaining orientation permits a play yard liner engaged with the retention members 108 to be secured in tension between adjacent retention members 108.

Figure 3:
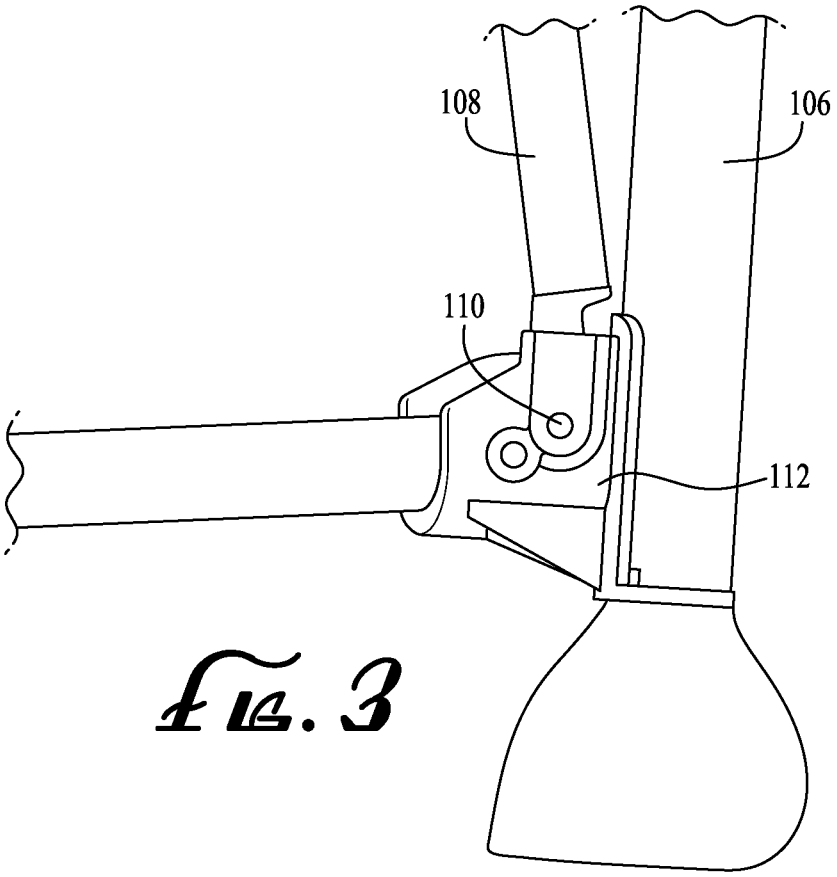
FIG. 3 shows a detailed side view of a retention member pivotally connected to a vertical frame member according to one embodiment of the present invention.

According to various embodiments, the retention members 108 may be configured to move between the inward receiving orientation and the retaining orientation in a variety of ways. For example, in the illustrated embodiment of FIGS. 1 and 2, each of the retention members 108 is pivotally connected to a respective vertical frame member 106 at its lower end. FIG. 3 shows a more detailed view of a lower end of one of the retention members 108. As shown, the retention member 108 is configured to pivot about a pin 110 (e.g., a horizontal axle) which is operatively connected to the vertical frame member 106 by a lower connecting member 112. In particular, the pin 110 is configured to permit the retention member 108 to pivot between the inward receiving orientation shown in FIG. 1 and the retaining orientation shown in FIG. 2. In the embodiments of FIGS. 1-4, the retention members 108 may be constructed, for example, from a substantially rigid material, such as aluminum or a high-modulus polymer material.

In another embodiment, the retention members 108 may be fixed in a non-pivotal manner to lower ends of the vertical members 106. In certain embodiments, the retention members 108 may be constructed from a flexible, resilient material that permits each retention member 108 to be resiliently deflected from a retaining orientation, such as that of FIG. 2, to an inward receiving orientation, such as that of FIG. 1. For example, a user may grasp an upper end of the retention member 108, bend it to an inward receiving orientation, and then permit the retention member to flex back to its natural retaining orientation. In other embodiments, the retention members 108 may be substantially rigid and not moveable, such that the retention member 108 is always in a retaining orientation. For example, in one embodiment, a removable fastener or cap is positioned on an upper end of non-moveable retention members 108 and may be removed to permit a liner sleeve to be slid over the retention members 108. In other embodiments, a liner is attached to a non-moveable retention member 108 by other engagement features, such as zippers, snaps, Velcro, grommets, or other engagement features described herein.

Figure 27:
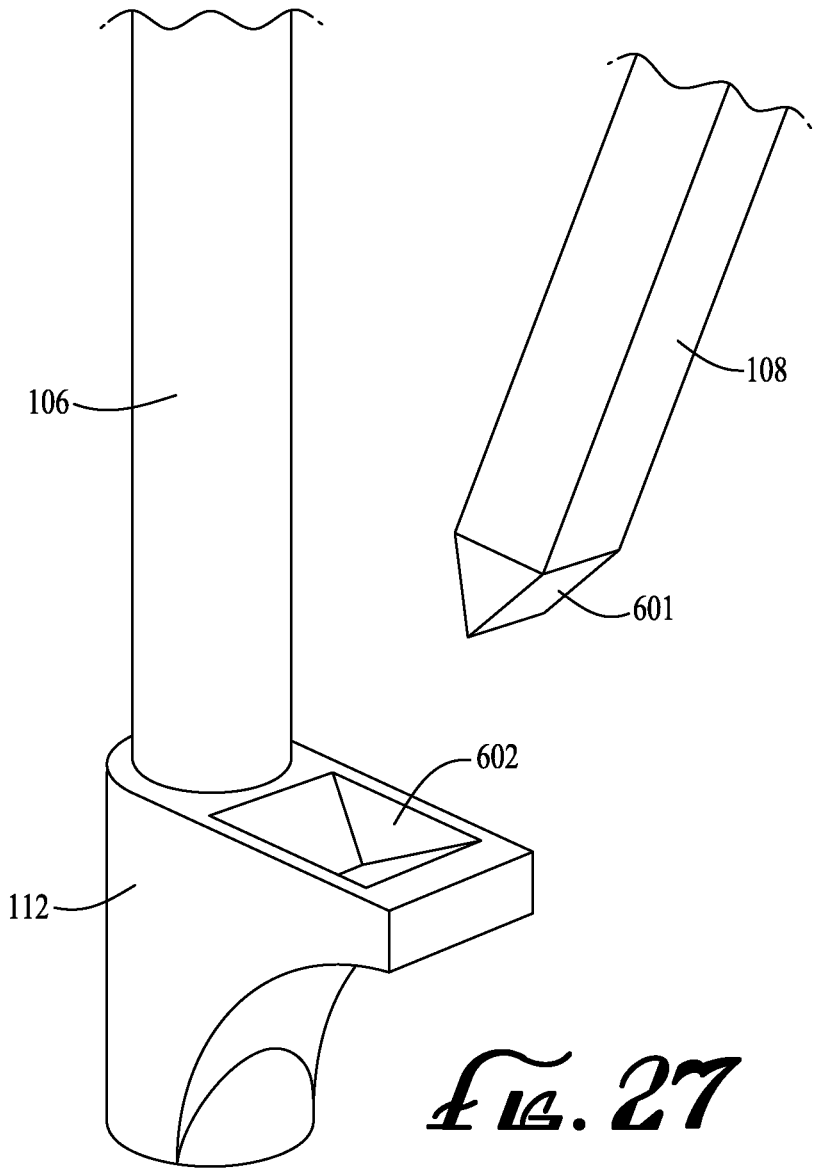
FIG. 27 shows a perspective view of a lower end of a retention member and vertical frame member according to one embodiment of the present invention.

In yet another embodiment, the retention members 108 may be fully detachable from the frame 100. For example, FIG. 27 illustrates one embodiment in which the retention member 108 is detachable from the frame 100 and includes a wedge member 601 disposed at a lower end of the retention member 108. In the illustrated embodiment, the lower connecting member 112, which is connected to the vertical frame member 106, defines an angled depression 602 configured to receive the wedge member 601. When the wedge member 601 is engaged within the angled depression 602, the retention member 108 is permitted to move between an inward receiving orientation (shown in FIG. 27) and a receiving orientation (in which the retention member's upper end may be secured to the vertical frame member 106). In another embodiment, retention member fastener—such as those described in greater detail herein—may be positioned on upper and lower ends of the retention members 108. In such an embodiment, the inward receiving orientation is one in which a respective retention member 108 is detached from the frame and the retaining orientation is one in which the retention member 108 is attached to the frame 100. Indeed, as will be appreciated from the description provided herein, the retention members 108 may be configured to move in any manner which secures the retention members 108 to the vertical frame members 106 and permits movement between an inward receiving orientation and a retaining orientation.

Figure 6:
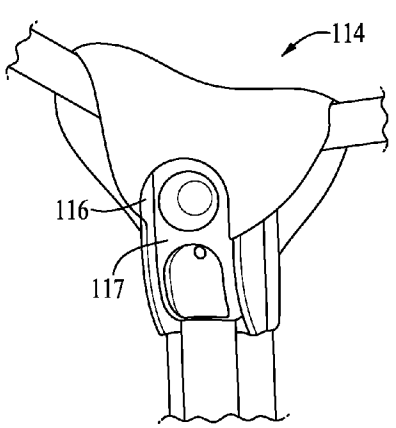
FIG. 6 shows another front perspective view of the retention member fastener of FIG. 4.
Figure 5:
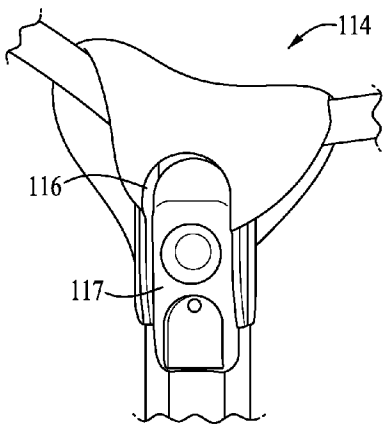
FIG. 5 shows a front perspective view of the retention member fastener of FIG. 4.
Figure 4:
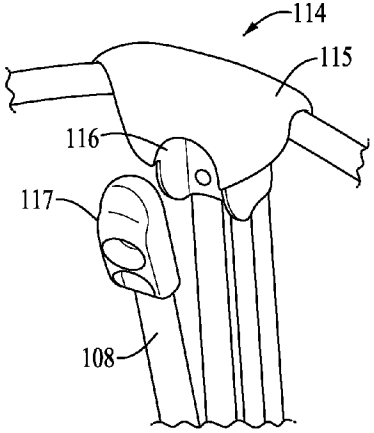
FIG. 4 shows a perspective view of a retention member fastener according to one embodiment of the present invention.

According to various embodiments, the frame 100 further includes retention member fasteners generally configured for securing the retention members 108 in the retaining orientation. For example, FIGS. 4-6 illustrate a retention member fastener 114 according to one embodiment. In the illustrated embodiment, the retention member fastener 114 is comprised of a retaining cavity 116 defined within an upper connecting member 115 and an engagement member 117 disposed on an upper end of one of the retention members 108. The upper connecting member 115 is secured to an upper end of the vertical frame member 106 and its cavity 116 is dimensioned to receive and secure the engagement member 117.

In the illustrated embodiment of FIGS. 4-6, the engagement member 117 is spring-loaded and configured to move between an extended position and a retracted position in response to a user-applied force. For example, FIG. 4 illustrates the retention member 108 in the inward receiving orientation and the engagement member 117 in its extended position. FIG. 5 illustrates the retention member 108 moved to its retaining orientation and the engagement member 117 moved to its refracted position (e.g., by a user pressing the engagement member 117 downward and compressing the spring). As shown in FIG. 5, when the engagement member 117 is in its retracted position, an upper end of the engagement member 117 will be positioned just below a lip of the cavity 116, thereby permitting the retention member 108 to be moved into its retaining orientation and the engagement member 117 to be positioned beneath the cavity 116. As shown in FIG. 6, when the engagement member 117 is permitted to move back to its extended position, the engagement member 117 extends into the cavity 116, thereby securing the retention member 108 in the retaining orientation. If a user wishes the move the retention member 108 back to its inward receiving orientation, the engagement member 117 may be pushed downward and disengaged from the cavity 116, thereby freeing the retention member 108 to move inward.

Figure 7:
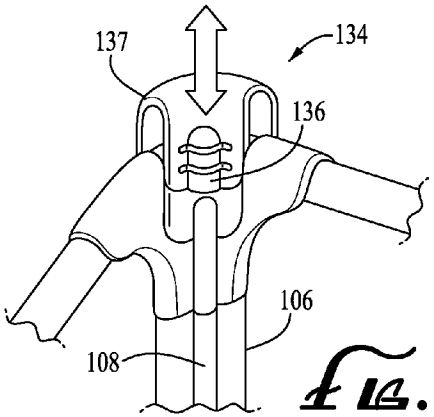
FIG. 7 shows a front perspective view of a retention member fastener according to another embodiment of the present invention.

FIG. 7 illustrates a retention member fastener 134 according another embodiment. In the illustrated embodiment, the retention member fastener 134 includes an engagement cap 137 configured to move along the vertical frame member 106 between an upper released positioned and a lower engaged position (e.g., as indicated by the directional arrows). The engagement cap 137 includes a cavity 136 dimensioned to slide over an upper portion of the retention member 108 and selectively secure the retention member 108 it its retaining orientation. In yet another embodiment, the retention member fastener may comprise one or more passive latches configured to enable the retention member 108 to be secured by pushing it over center past a material designed to deflect away from the retention member 108 and rebound in order to capture the retention member 108 (e.g., a leaf spring). As will be appreciated from the description herein, the frame's retention member fasteners may comprise any fastener suitable for selectively securing the retention members 108 in the retaining orientation.

Figure 8:
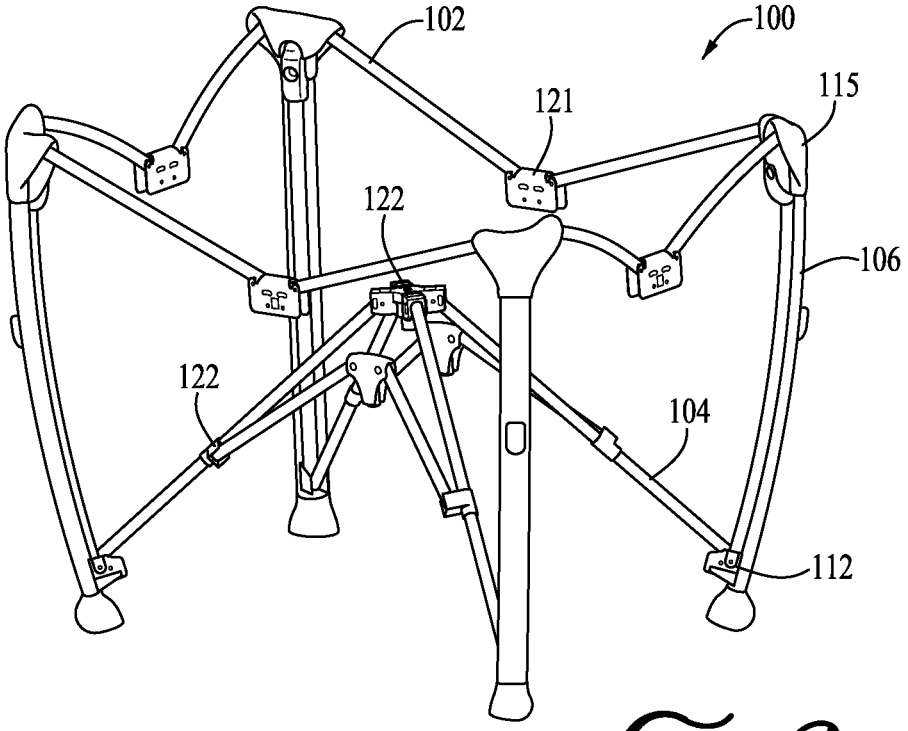
FIG. 8 shows a perspective view of a partially collapsed play yard frame according to one embodiment of the present invention.

In certain embodiments, the frame 100 is also configured to be collapsed into a more compact form in order to minimize the space required for storage. For example, FIG. 8 illustrates the frame 100 in a partially collapsed state according to one embodiment. In the illustrated embodiment, the upper horizontal frame members 102 are pivotally connected to one another by upper joint members 121 and pivotally connected to the vertical frame members 106 by the upper connecting members 115. As shown in FIG. 8, each upper horizontal frame member 102 is secured to an upper joint member 121 and an upper connecting member 115 by pins that permit the upper horizontal frame member 102 to pivot in a downward direction. In a particular embodiment, the upper connecting members 115 and upper joint members 121 permit each of the upper horizontal frame members 102 to move downward along a plane perpendicular to a support surface on which the frame 100 rests.

Likewise, the lower horizontal frame members 104 are pivotally connected to one another by lower joint members 122. In addition, certain of the lower horizontal frame members 104 are pivotally connected to the vertical frame members 106 by lower connecting members 112. As shown in FIG. 8, the lower horizontal frame members 104 are secured to the various lower joint members 122 and connecting members 112 by pins that permit the lower horizontal frame members 104 to pivot in an upward direction.

Figure 9:
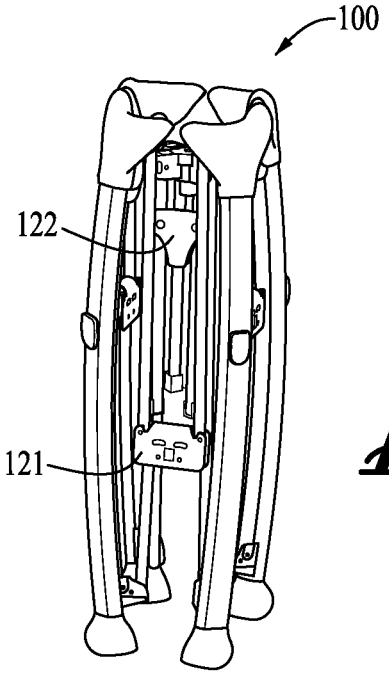
FIG. 9 shows a perspective view of a fully collapsed play yard frame according to one embodiment of the present invention.

FIG. 9 illustrates the frame 100 in a fully collapsed state according to one embodiment. By pivoting the upper horizontal frame members 102 downward and the lower horizontal frame members 104 upward, the vertical frame members 106 are able to move inward and adjacent one another, thereby achieving the fully collapsed state of FIG. 9. According to various embodiments, one or more of the various joint members 121, 122 and connecting members 115, 112 may further include locking mechanisms configured to selectively lock the frame 100 in an expanded position, such as that of FIGS. 1 and 2, and selectively unlock the frame 100 to permit it to be collapsed to a storage position, such as that of FIG. 9. In addition, a quick release mechanism may be provided to permit a user easily unlock or lock the frame 100. Further, as will be appreciated from the description herein, the frame 100 may be collapsed with or without a play yard liner secured to it (e.g., the liner 200 described below).

According to various embodiments, the various components of the frame 100 described herein may be constructed from a variety of materials of suitable strength for withstanding loads applied by the removable play yard liner and any children or other items placed therein (e.g., dynamic loads resulting from a child jumping). For example, the various frame members 102, 104, 106 may be constructed from generally rigid materials, such as aluminum or high-modulus polymer materials.

As will be appreciated from the description herein, various modifications may be made to the play yard frame embodiments described herein while remaining within the scope of the present inventions. In various embodiments, the play yard frame may include any number of vertical frame members, which may be arranged in a variety of ways. As an example, the play yard frame may include a plurality of vertical frame members positioned in a triangular, trapezoidal, or circular relationship. In addition, the play yard frame may include retention members disposed on some or all of the vertical frame members, and may include more than one retention member disposed on a single vertical frame member. Further, in various embodiments, the play yard frame's upper and lower horizontal frame members may be comprised of any number of individual members, including a single, unitary upper or lower horizontal frame member. In addition, the play yard frame may be configured not to collapse.

Play Yard Liner

Figure 10:
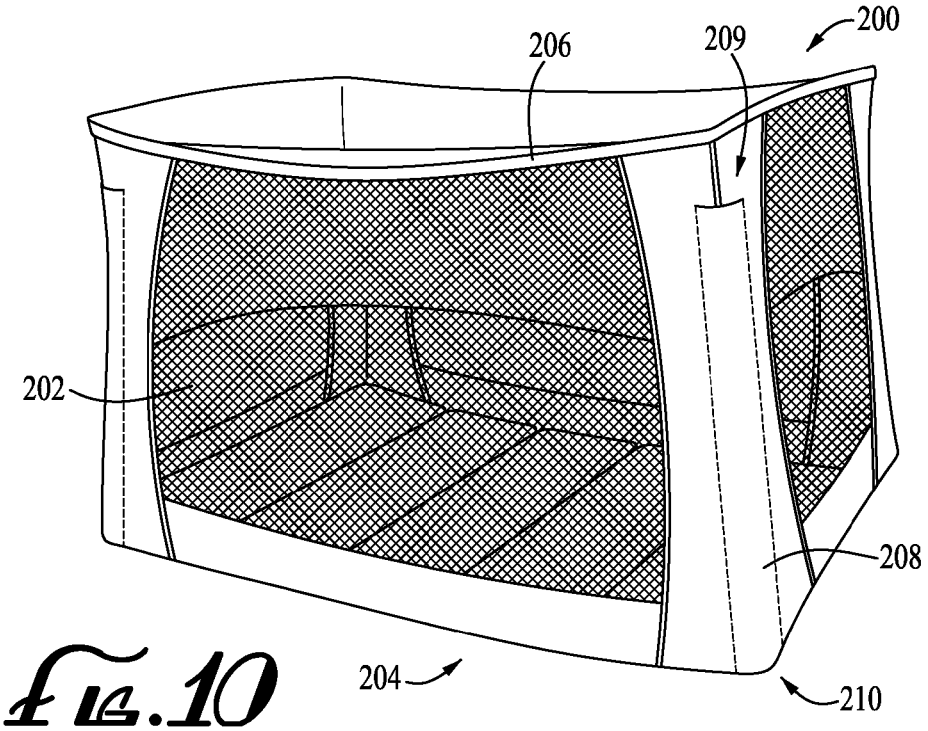
FIG. 10 shows a perspective view of a play yard liner according to one embodiment of the present invention.

FIG. 10 illustrates a play yard liner 200 according to one embodiment. In the illustrated embodiment, the liner 200 is a unitary fabric enclosure defined by four sidewalls 202 and a floor panel 204. Together, the sidewalls 202 and floor panel 204 define a partially enclosed area having an upper opening and a generally rectangular cross-section. The sidewalls 202 further define an upper perimeter 206 of the liner 200. According to certain embodiments, fasteners—such as zipper teeth shown in FIG. 10—are disposed along the upper perimeter 206.

The liner 200 further includes four sleeves 208 each defined by fabric material attached to an outer portion of the liner 200 at the liner's four corners. In FIG. 10, one of the sleeves 208 is outlined by dashed lines to generally indicate the boundaries of the sleeve 208. As shown, each of the sleeves 208 defines a lower opening 210 positioned at a lower edge of the liner 200, and extends vertically along the liner 200 to a point slightly below the liner's upper perimeter 206 where it defines an upper opening 209. According to various embodiments, the sleeves 208 are generally dimensioned to be slid over the retention members 108 of the play yard frame 100.

Figure 11:
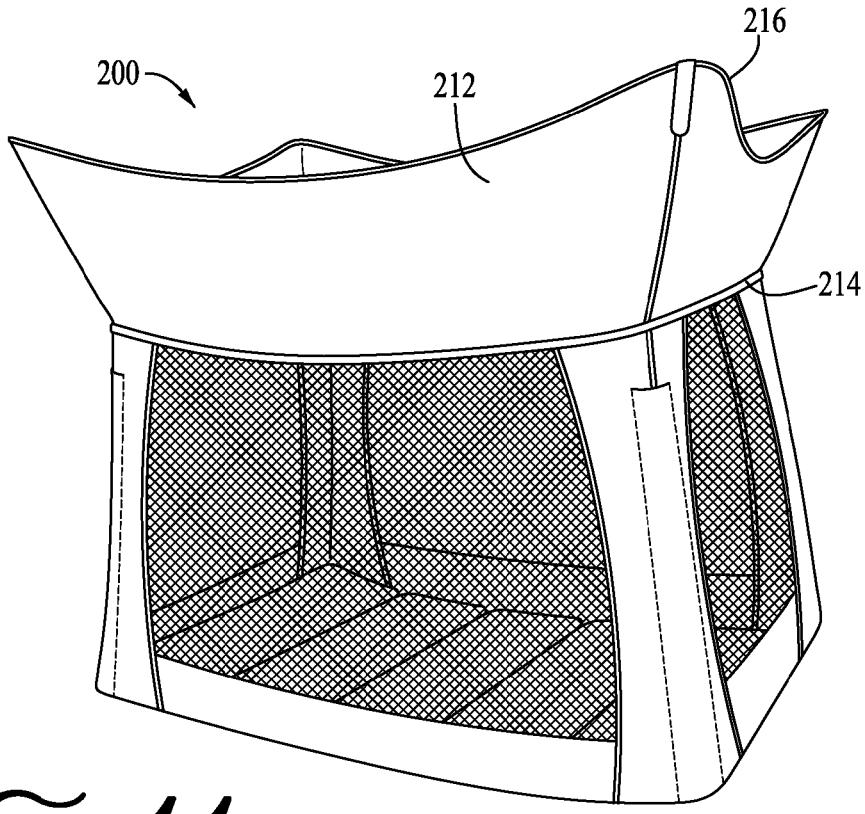
FIG. 11 shows another perspective view of the play yard liner of FIG. 10.

As shown in FIG. 11, the liner 200 further includes a flap panel 212, which extends outwardly from the liner's upper perimeter 206. In various embodiments, the flap panel 212 is a fabric panel having an inner edge 214 that extends along the liner's upper perimeter 206. The flap panel 212 further includes an outer edge 216 having a curved profile in which portions of the outer edge 216 adjacent the liner's corners extend further from the inner edge 214 than medial portions of the outer edge 216.

As shown, the sidewalls 202 are generally formed from a breathable mesh fabric material with solid fabric material surrounding the mesh material along edge portions of the sidewalls 202. Likewise, the floor panel 204 may be formed from, for example, a solid fabric material. In certain embodiments, the fabric materials used to form various components of the liner 200 are constructed from a washable fabric material, such as nylon. In particular embodiments, the liner 200 is configured to be machine-washed without sustaining damage to its various components. As will be appreciated from the description herein, it is contemplated that the various components of the liner 200—including the sidewalls 202, floor panel 204, and sleeves 208—may be constructed from a variety of suitable materials, including various combinations of fabric and non-fabric materials.

As will be appreciated from the description herein, various modifications may be made to the play yard liner embodiments described herein while remaining within the scope of the present inventions. For example, in certain embodiments the play yard liner may not include a floor panel and/or a flap panel. In addition, according to various embodiments, the sleeves of the play yard liner may be disposed along an interior portion of the liner (e.g., by attaching sleeve material to an inner portion of the sidewalls), may be disposed along fabric tabs extending outwardly from the liner, and may be comprised of multiple segments or loops.

Further, various embodiments of the play yard liner may be configured to be secured to the various embodiments of the play yard frame described herein. As such, the liner may include any number of sidewalls arranged in a variety of ways corresponding to a particular play yard frame embodiment. As an example, the liner may include a plurality of sidewalls defining a shape other than the rectangular shape illustrated herein. For example, the liner may comprise a single or multiple sidewalls defining other shapes such as rounded rectangles, circles, ovals, triangles, and pentagons. In yet another embodiment, the liner may be comprised of separate sidewall panels configured to be individually positioned on the play yard frame. For example, such separate sidewall panels may each include sleeves disposed on side edges of the panels, fasteners such as zipper teeth disposed on upper edges, and/or individual flap panels. In addition, the liner may include any number of sleeves positioned on the liner to correspond with one or more retention members of the play yard frame.

Securing the Play Yard Liner to the Play Yard Frame

As noted earlier, various embodiments of the play yard liner 200 are configured to be secured to the play yard frame 100 in order to provide a play yard for a child. FIGS. 12-26 illustrate various steps of a method for securing the liner 200 to the frame 100 according to various embodiments.

Figure 12:
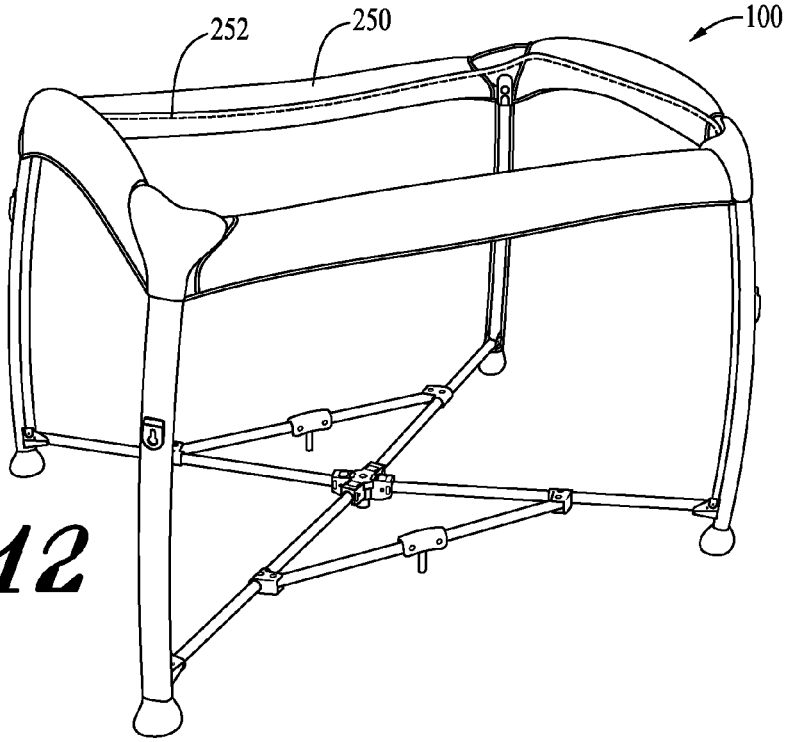
FIG. 12 shows a perspective view of a play yard frame with padded members secured thereto according to one embodiment of the present invention.

First, as shown in FIG. 12, one or more padded members 250 are fitted to the upper horizontal frame members 102 of the frame 100. In the illustrated embodiment, the padded members 250 form a single, unitary padded structure that includes a row of zipper teeth 252 disposed continuously around an inner portion of the padded members 250. In one embodiment, the padded members 250 are permanently attached to the upper horizontal frame members 102 during the manufacturing process and configured to bend and fold with the upper horizontal frame members 102 as they are collapsed or expanded. In another embodiment, the padded members 250 are configured to be secured to the upper horizontal frame members 102 by a user (e.g., by wrapping the padded members 250 around the upper horizontal frame members 102 and securing them in place with fasteners, such as snaps, buckles, zippers, or Velcro). For example, in one embodiment, the padded members 250 are attached to the liner 200 and configured to be wrapped around and secured to the upper horizontal frame members 102. In addition, in various embodiments, the padded members 250 may comprise a number of separate, individually secured components (as opposed to the single, unitary structure of FIG. 12). Further, in certain embodiments, the unpadded members having the same or similar structure to the padded members 250 may be used with, or in place of, the padded members 250.

Figure 13:
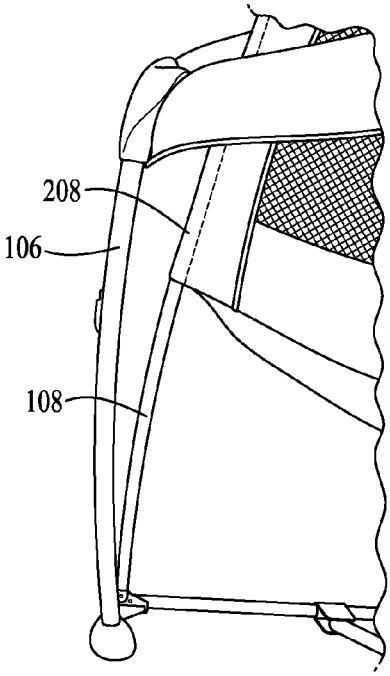
FIG. 13 shows a side view of a retention member partially inserted into the sleeve of a play yard liner according to one embodiment of the present invention.
Figure 14:
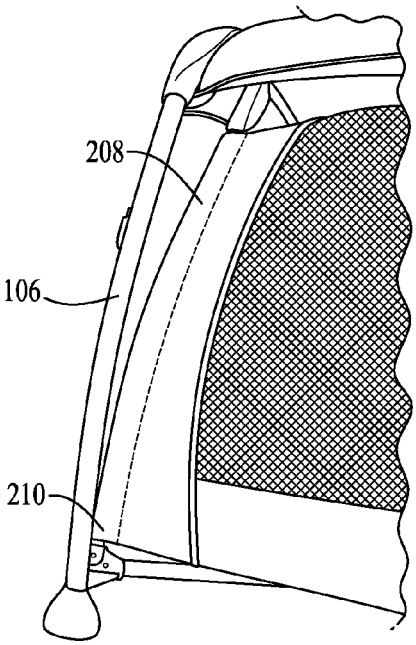
FIG. 14 shows a side view of a retention member fully inserted into the sleeve of a play yard liner according to one embodiment of the present invention.

Next, as shown in FIG. 13, each of the frame's retention members 108 are disengaged from their respective retention member fasteners 114 and pivoted away from the vertical frame members 106 to an inward receiving orientation. Each of the sleeves 208 of the liner 200 are then slid over respective retention members 108 (e.g., by inserting the upper end of the retention member 108 into lower opening 210 of the sleeve 208 and pulling the sleeve 208 downward). As shown in FIG. 14, each sleeve 208 is moved downward until its lower opening 210 is positioned adjacent the lower end of its respective retention member 108. In embodiments in which the retention members 108 are fixed to the vertical frame members 106, each retention member 108 may be flexed to its inward receiving orientation to receive the sleeves 208. In embodiments in which the retention members 108 are detachable from the frame 100, each retention member 108 may be detached from the frame 100, inserted through a liner sleeve 208, and subsequently reattached to the frame 100 in the retaining orientation.

Figure 15:
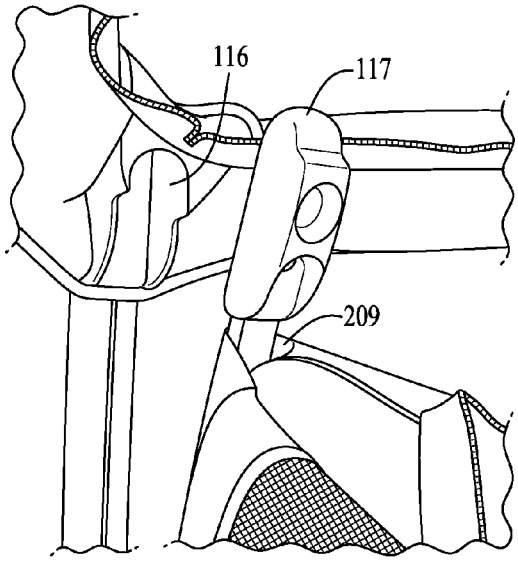
FIG. 15 shows a perspective view of a retention member fastener with a disengaged engagement member according to one embodiment of the present invention.

FIG. 15 illustrates one of the engagement members 117 when its respective retention member 108 is fully inserted through the sleeve 208 and is still in the inward receiving orientation. As can be seen in FIG. 15, when the retention members 108 are fully inserted into the sleeves 108, their respective engagement members 117 will extend just above the upper openings 209 of the sleeves 208. This prevents the sleeves 208 from being caught in any component of the retention member fasteners 114.

Figure 16:
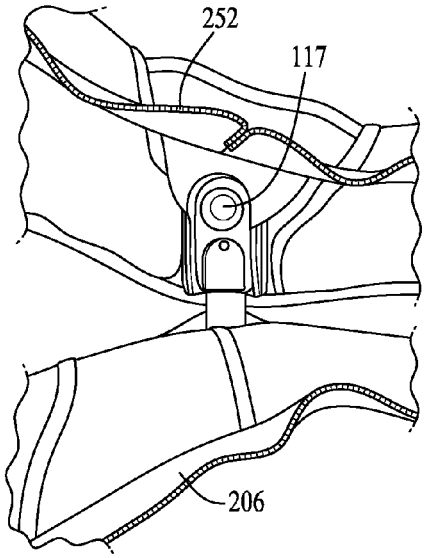
FIG. 16 shows a front view of the retention member fastener of FIG. 15 with an engaged engagement member.

Next, as shown in FIG. 16, the engagement member 117 of each retention member 108 is retracted (e.g., by pushing the engagement member downward) and its respective retention member 108 is pivoted back into the retaining orientation. The engagement member 117 is then permitted to extend into the cavity 116 of the retention member fastener 114, thereby securing the retention member 108 in the retaining orientation. In other embodiments, the engagement member 117 is not retractable and is configured to be inserted into the cavity 116 with force applied by a user (e.g., via a cam-like motion). As a result of performing these steps for each of the sleeves 208 and retention members 108, the sidewalls 202 and floor panel 204 of the liner 200 will be held in tension between the various retention members 108. In addition, in the illustrated embodiment, when the retention members 108 are fully inserted through the sleeves 208 and positioned in the retaining orientation, the sleeves 208 remain out of contact with the vertical frame members 106, thereby reducing the amount of friction and wear applied to the sleeves 208.

Figure 17:
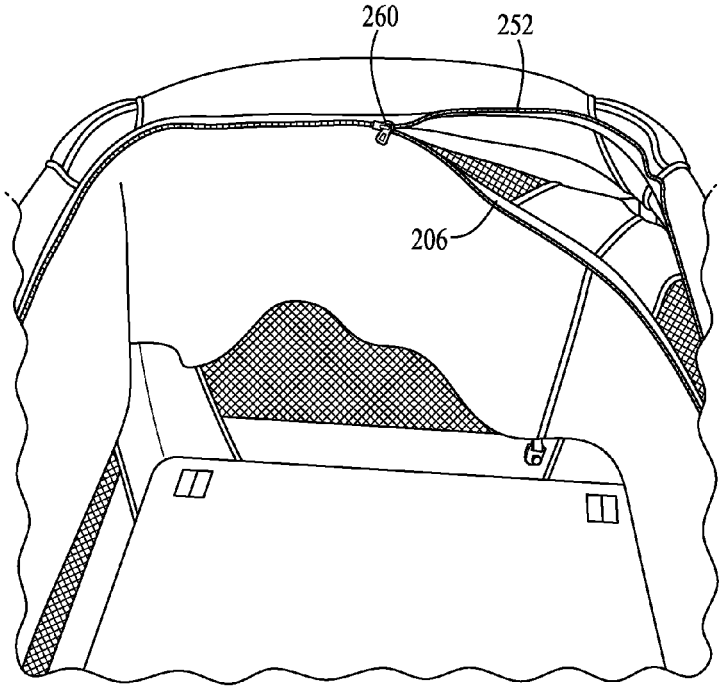
FIG. 17 shows an elevated front view of a play yard frame with liner partially secured thereto according to one embodiment of the present invention.

As can be seen in FIG. 16, when the retention member 108 are secured in their retaining orientation, the zipper teeth 252 of the padded members 250 and the zipper teeth disposed along the upper perimeter 206 of the liner 200 are positioned proximate to one another. Accordingly, as shown in FIG. 17, the zipper teeth 252 of the padded members 250 and the zipper teeth disposed along the upper perimeter 206 of the liner 200 are engaged with each other by a zipper 260. By fully engaging the zipper teeth, the upper perimeter 206 of the liner 200 is secured to the padded members 250 and thereby to the upper horizontal frame members 102 as well. This provides additional support to secure the sidewalls 202 of the liner 200 in a substantially upright, vertical position around the perimeter of the play yard.

Figure 18:
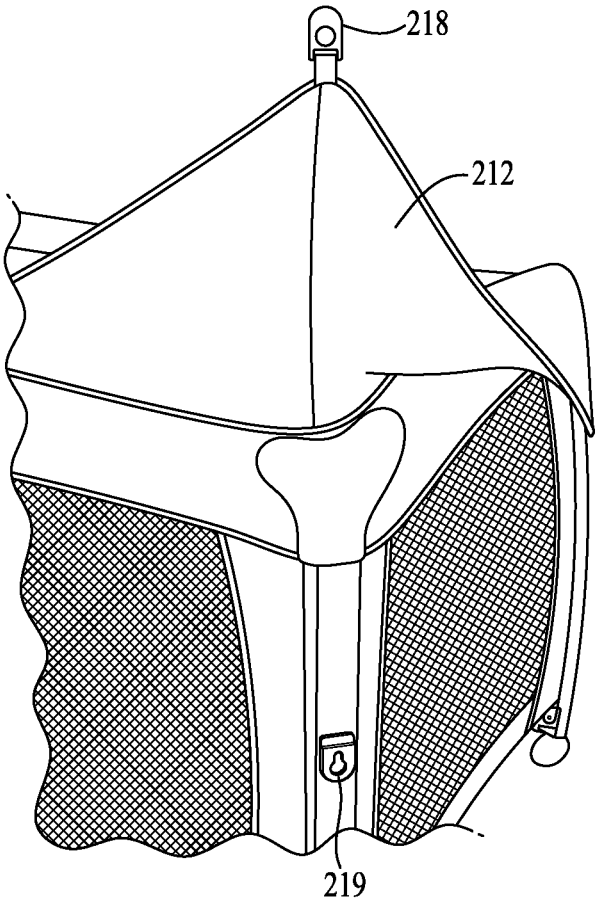
FIG. 18 shows a perspective view of a flap panel elevated above a play yard frame according to one embodiment of the present invention.
Figure 19:
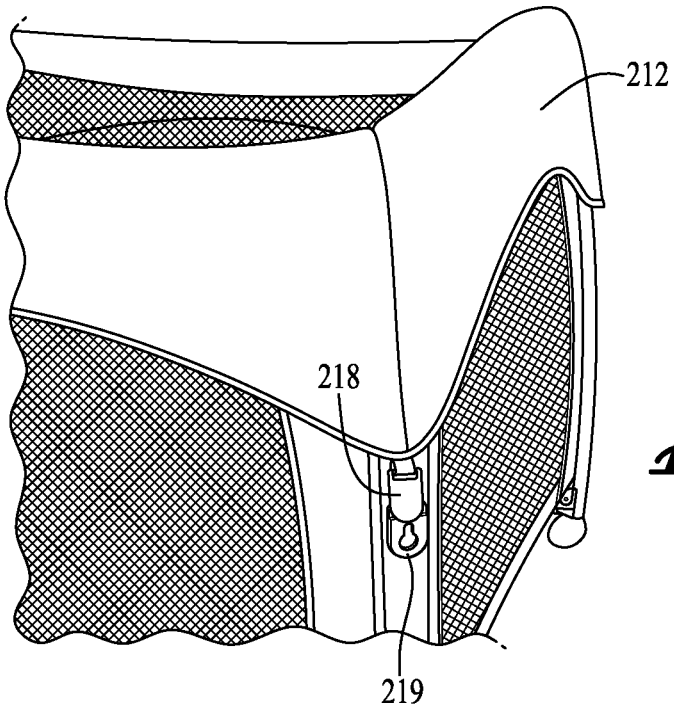
FIG. 19 shows a perspective view of a flap panel secured to a vertical frame member according to one embodiment of the present invention.

Next, as shown in FIG. 18, the flap panel 212 of the liner 200 is lifted over the upper horizontal frame members 102 and padded members 250 and pulled downward adjacent the outer sides of the sidewalls 202. As shown, the flap panel 212 includes flap fasteners 218 disposed adjacent corner regions along its outer edge 216. The flap fasteners 218 are configured to engage flap mating fasteners 219 positioned on an outer portion of the vertical frame members 106. Accordingly, as shown in FIG. 19, the flap fasteners 218 are next engaged with the flap mating fasteners 219, thereby securing the flap panel 212 over the upper horizontal frame members 102 and padded members 250, and down the sides of the sidewalls 202 and vertical frame members 106. By securing the flap panel 212 in this manner, the flap panel fully covers all components of the frame 100 accessible from the interior of the play yard and provides a safety barrier between a child positioned within the play yard and the various frame components.

Figure 20:
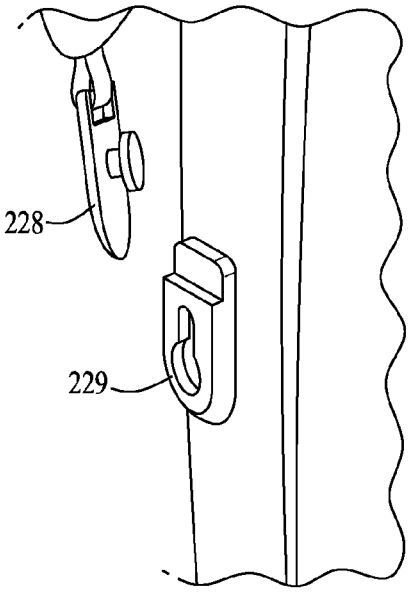
FIG. 20 shows a perspective view of a disengaged flap fastener and flap mating fastener according to one embodiment of the present invention.
Figure 21:
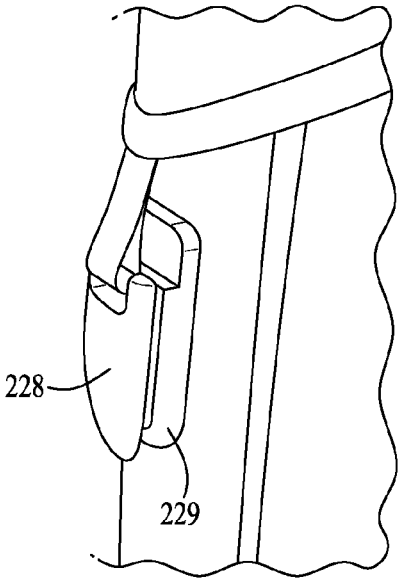
FIG. 21 shows a perspective view of the flap fastener and flap mating fastener of FIG. 20 engaged.
Figure 22:
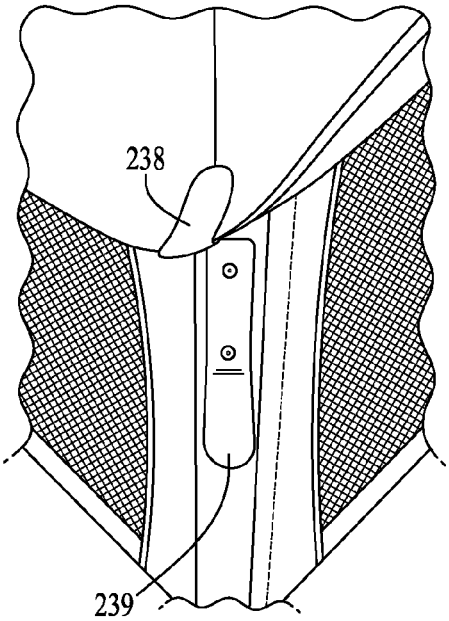
FIG. 22 shows a perspective view of a disengaged flap fastener and flap mating fastener according to another embodiment of the present invention.
Figure 23:
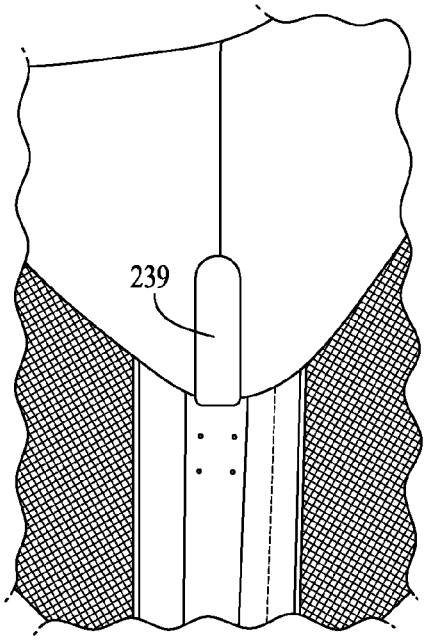
FIG. 23 shows a perspective view of the flap fastener and flap mating fastener of FIG. 22 engaged.

As shown in FIGS. 20 and 21, in one embodiment, the flap fastener 218 comprises a fastening member 228 having a rigid protrusion, while the flap mating fastener 219 comprises a receiving member 229 having a cavity configured to receive the rigid protrusion of the fastening member 228 in order to secure the flap panel 212. In another embodiment, as shown in FIGS. 22 and 23, the flap fastener 218 comprises a first Velcro strap 238, and the flap mating fastener 219 comprises a second Velcro strap 239 configured to engage the first Velcro strap 238 in order the secure the flap panel 212. As will be appreciated from the description herein, the flap fastener 218 and flap mating fastener 219 may be comprised of any other suitable fasteners, including—but not limited to—snaps, buckles, and hook and loop combinations.

Figure 24:
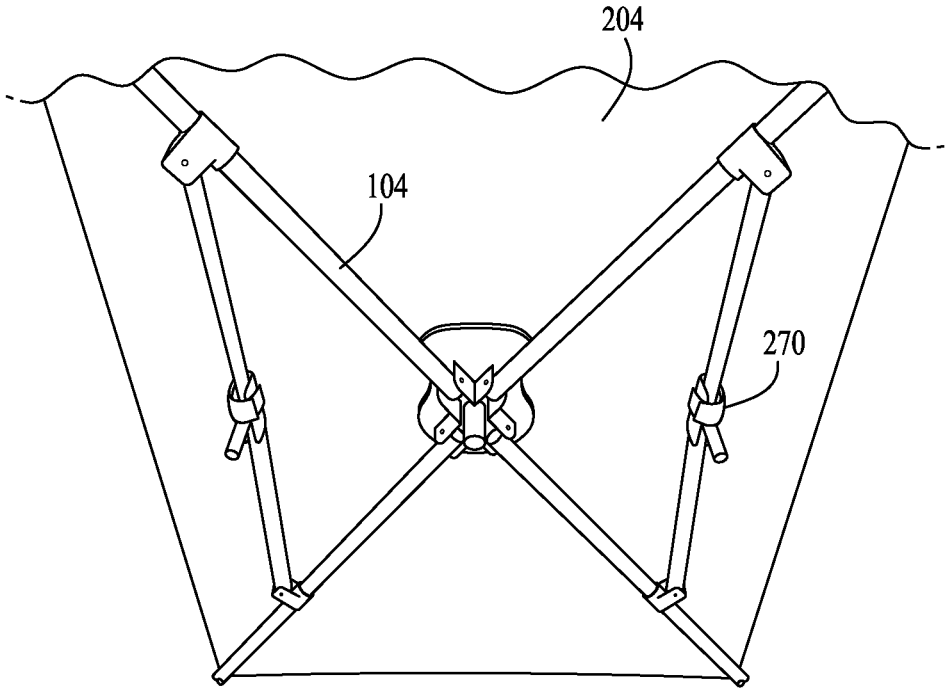
FIG. 24 shows a bottom view of a liner floor panel secured to lower frame members according to one embodiment of the present invention.

Next, as shown in FIG. 24, the floor panel 204 of the liner 200 is secured to the lower horizontal frame members 104 by floor panel fasteners 270. According to various embodiments, the floor panel fasteners 270 may comprise any suitable fasteners, such as straps or loops engaged by Velcro, snaps, buckles, or a D-ring. In addition, according to various embodiments, any number of floor panel fasteners 270 may be provided in order to secure the floor panel 204 to various portions of the frame 100, including—but not limited to—the lower connecting members 112 and various lower horizontal frame members 104.

Figure 25:
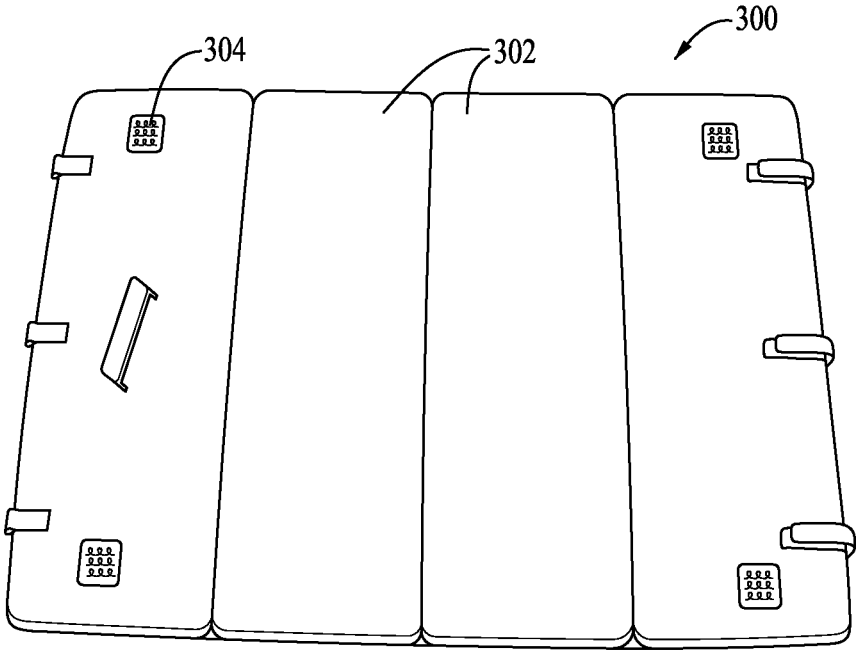
FIG. 25 shows a top view of a mattress pad according to one embodiment of the present invention.

Finally, a mattress pad 300 may be placed on top of the floor panel 204 in order to provide a comfortable, supportive surface for a child. As shown in FIG. 25, in one embodiment, the mattress pad 300 is comprised of a number of padded panels 302 foldably attached to one another and, together, dimensioned to fit within the interior of the play yard. According to various embodiments, the mattress pad 300 may include any number of fasteners configured to secure the mattress pad 300 to the play yard. For example, in the illustrated embodiment of FIG. 25, the mattress pad 300 includes a plurality of Velcro patches 304 positioned at the corners of the mattress pad 300. In one embodiment, corresponding Velcro patches are disposed on the upper surface of the floor panel 204 in order to mate with the Velcro patches 304 and secure the mattress pad 300. In addition, the mattress pad 300 may further include a removable, washable slipcover.

Figure 26:
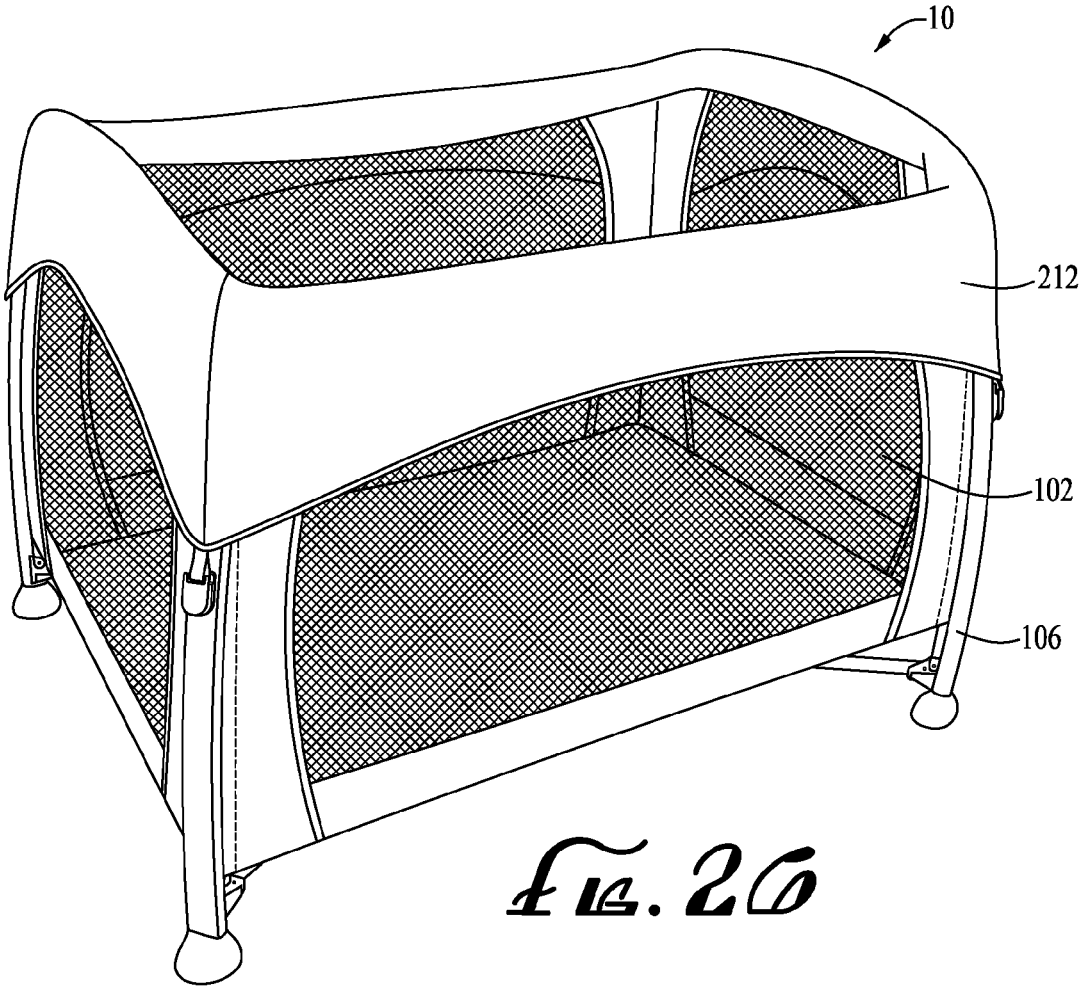
FIG. 26 shows a perspective view of an assembled play yard according one embodiment of the present invention.

FIG. 26 illustrates a play yard 10 comprised of the frame 100 and liner 200, and assembled according to the steps described herein. As shown, the liner's sidewalls 202 are supported in tension by the retention members 108 (not visible) and define a substantially vertical, rectangular boundary around the perimeter of the play yard 10. In addition, the flap panel 212 is shown in its secured state preventing access to frame components from the interior of the play yard 10.

As will be appreciated from the description herein, various modifications may be made to the play yard and play yard assembly method described herein while remaining within the scope of the present inventions. For example, in certain embodiments, the zipper teeth 252 of the padded members 250 and zipper teeth disposed along the upper perimeter 206 of the liner 200 may be comprised of multiple segments of zipper teeth disposed at particular locations around the upper perimeter 206, rather than around the entire perimeter 206. In various other embodiments, other types of fasteners—such as snaps, buckles, or Velcro—may be used to secure the upper perimeter 206 of the liner 200 to the padded members 250 (e.g., in place of the aforementioned zipper teeth). In addition, in other embodiments, the padded members may be attached directly to the liner 200 and configured to be wrapped and secured around the upper horizontal frame members 102. In other embodiments, fasteners may be disposed directly on the upper horizontal frame members 102 and configured to engage fasteners disposed along the upper perimeter 206 of the liner 200.

Figure 28:
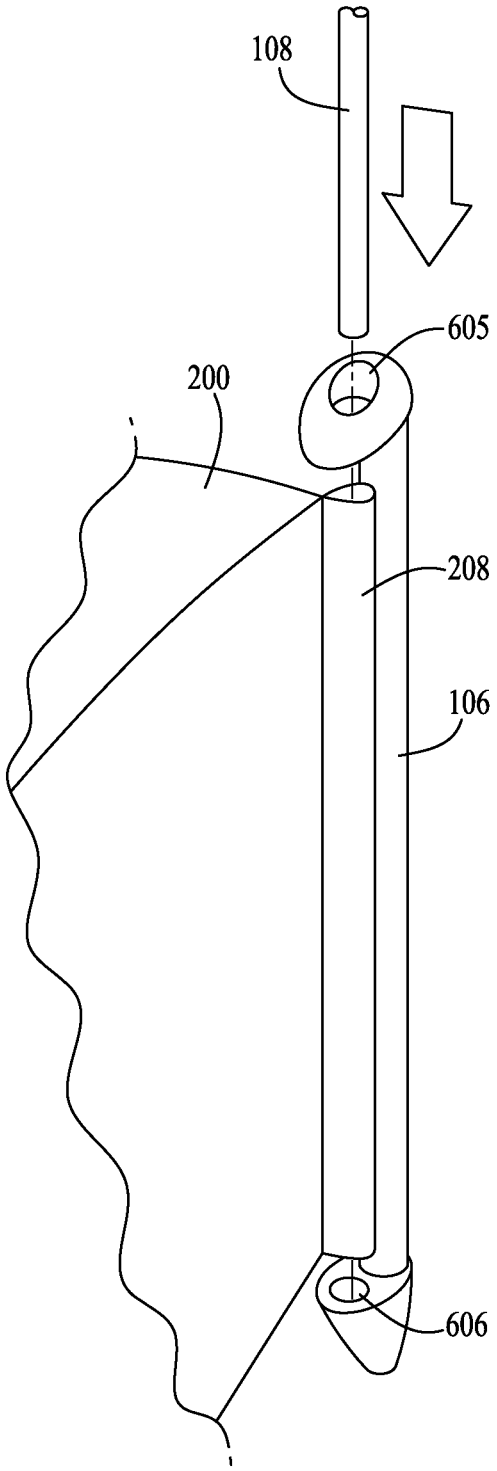
FIG. 28 shows a perspective view of a retention member in a receiving orientation relative to a play yard liner having a sleeve according to one embodiment of the present invention.

In addition, various other embodiments of the liner 200 may be secured to frame retention members 108 in a variety of ways. For example, FIG. 28 illustrates one embodiment in which the retention members 108 are fully detachable from the frame 100 and secured to the vertical frame member 106 by being inserted through an upper frame aperture 605 and into a lower frame depression 606. In the illustrated embodiment, the liner 200 may be secured to the retention members 108 by moving a retention member 108 into a receiving orientation above the frame 100, positioning a liner sleeve 208 between the upper frame aperture 605 and lower frame depression 606, and moving the retention member 108 through the aperture 605, through the sleeve 208, and into a retaining orientation in which the retention member's lower end is engaged within the depression 606 and the retention member's upper end is secured within the aperture 605.

Figure 29:
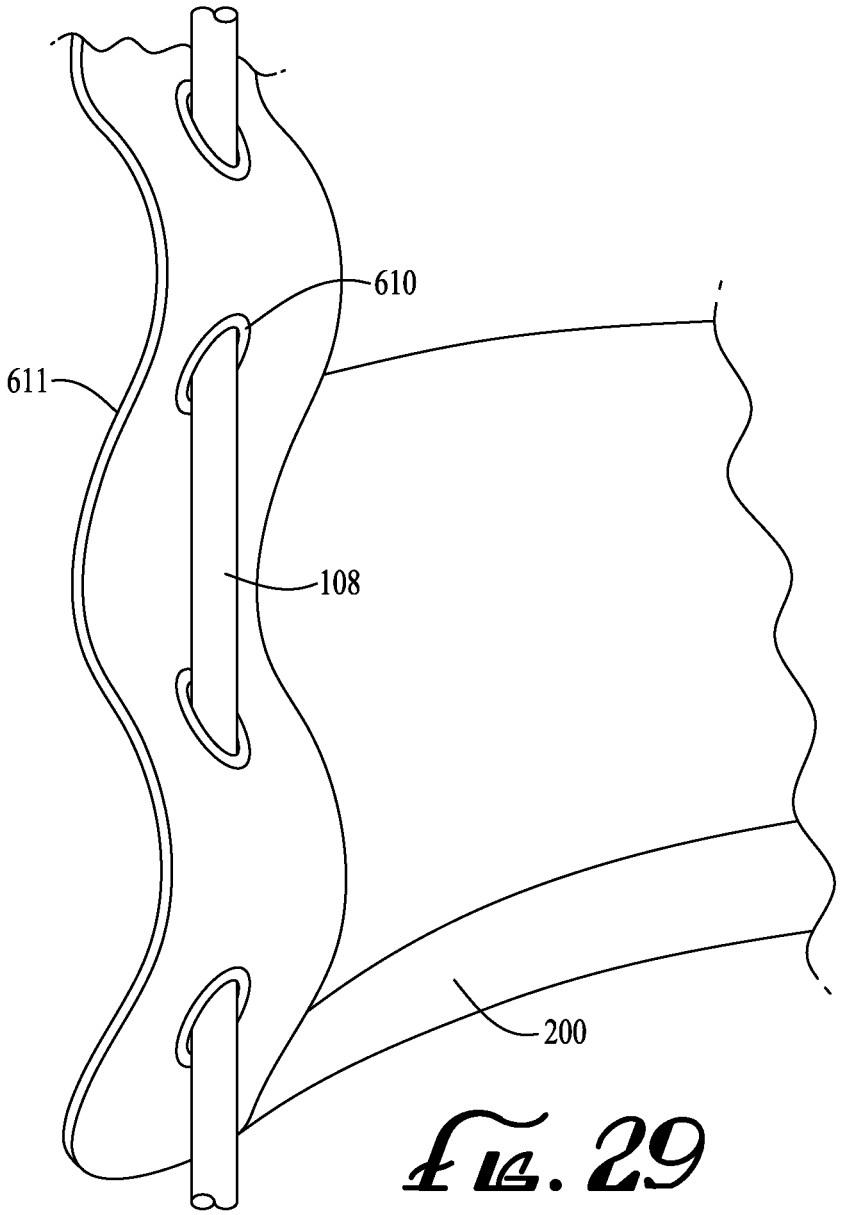
FIG. 29 shows a detailed side view of a retention member inserted through apertures of a play yard liner according to one embodiment of the present invention.

As another example, FIG. 29 illustrates one embodiment in which the liner 200 includes a plurality of liner apertures 610 (e.g., grommets) defined along the length of a tab 611 connected to the liner 200. In the illustrated embodiment, the liner apertures 610 are dimensioned such that a retention member 108 may be inserted through the apertures 610. As such, the liner 200 may be secured to the retention member 108 by moving the retention member 108 into a receiving orientation, connecting the tab 611 to the retention member 108 by sliding the apertures 610 over the retention member 108, and moving the retention member 108 into a retaining orientation. In other embodiments the apertures 610 may be defined on the sidewalls 202 of the liner 200 (e.g., a lower aperture may be defined proximate a lower edge of a liner sidewall and an upper aperture may be defined proximate an upper edge of the liner sidewall above the lower aperture).

Figure 30:
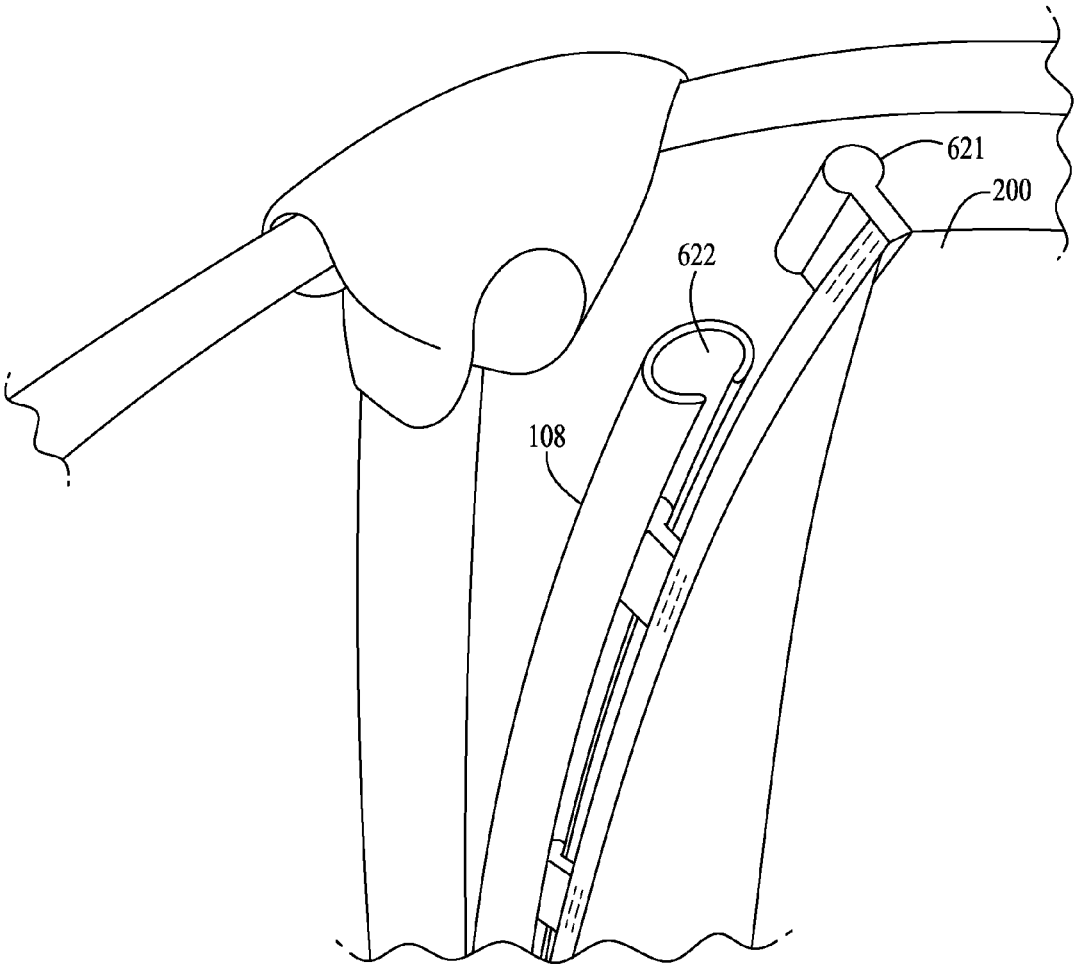
FIG. 30 shows a perspective view of a retention member in a receiving orientation relative to a play yard liner having channel engagement members according to one embodiment of the present invention.
Figure 31:
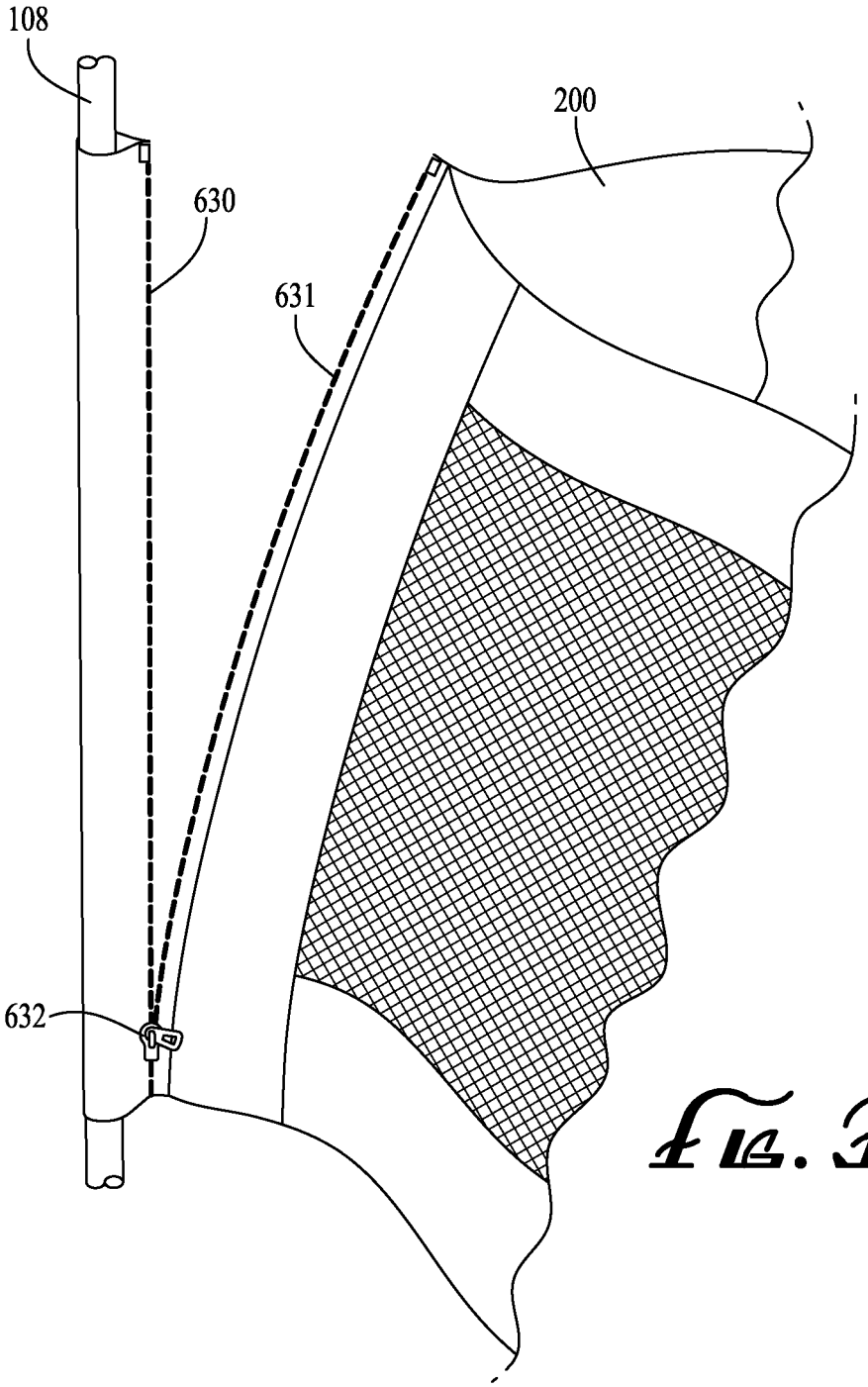
FIG. 31 shows a perspective view of a retention member in a receiving orientation relative to a play yard liner having zipper teeth according to one embodiment of the present invention.

As yet another example, FIG. 30 illustrates one embodiment in which the retention members 108 define a longitudinal channel 620 configured to receive one or more engagement members 621 positioned longitudinally along an edge (or tab) of the liner 200. In the illustrated embodiment, the liner 200 may be secured to the retention member 108 by moving the retention member 108 into a receiving orientation, sliding the engagement members 621 into the channel 620 such that an edge of the liner 200 is disposed adjacent the retention member 608, and moving the retention member 108 into a retaining orientation. In addition, as yet another example, FIG. 31 illustrates one embodiment in which a first row of zipper teeth 630 is disposed along the length of a retention member 108 (e.g., zipper teeth secured to fabric secured around the retention member 108) and a second row of zipper teeth 631 is disposed longitudinally along an edge of the liner 200 (e.g., disposed along the sidewalls 202 of the liner 200, or along a tab extending from the sidewalls 202). In the illustrated embodiment, the liner 200 may be secured to the retention member 108 by moving the retention member 108 into a receiving orientation, engaging the first row of zipper teeth 630 and second row of zipper teeth 631 with a zipper 632, and moving the retention member 108 into a retaining orientation.

In addition, according to various embodiments, the liner 200 may not include a flap panel 212 or a floor panel 204. In such embodiments, the above described steps of securing the flap panel 212 and floor panel 204 may be skipped. In addition, in embodiments in which the liner 200 does not include a floor panel, the mattress pad 300 may be secured directly to the lower horizontal frame members 104 using suitable fasteners. In addition, as will be appreciated from the description herein, various steps in the method for securing the liner 200 to the frame 100 described herein may be modified or omitted, and new steps may be added, in accordance with the various liner and frame embodiments described herein.

Play Yard Frame with Removable Upper Frame Members

Figure 32:
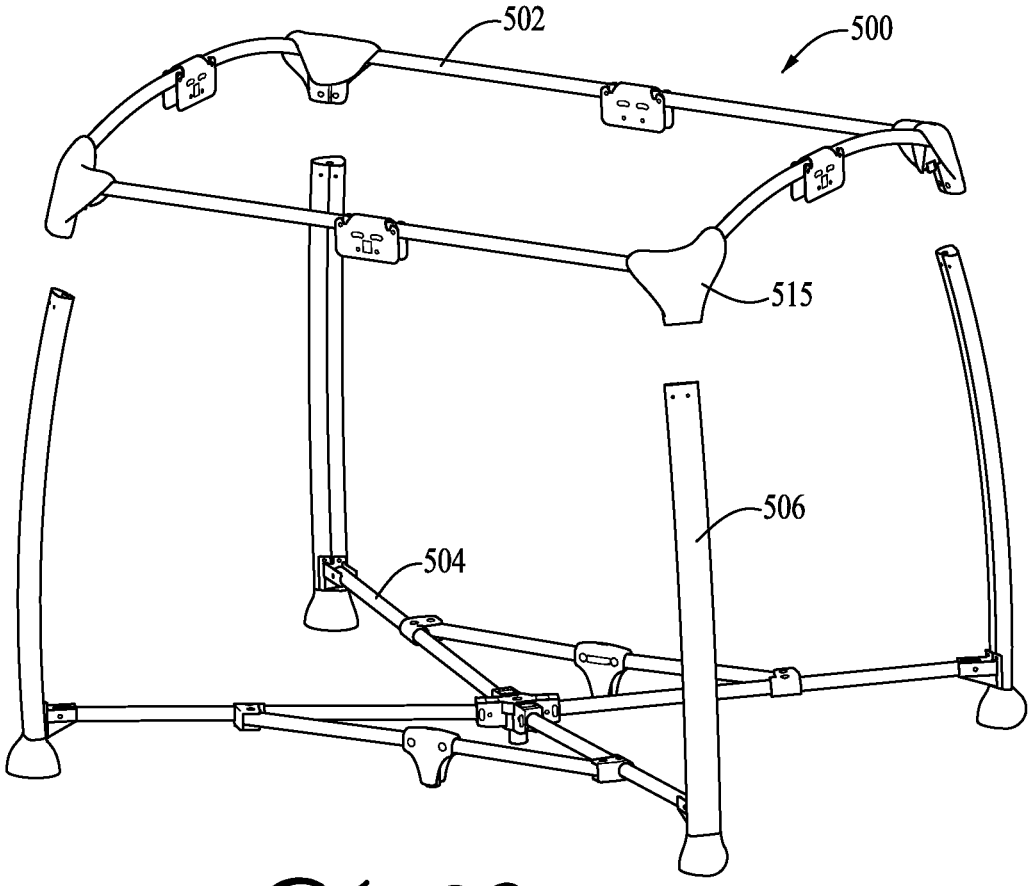
FIG. 32 shows a perspective view of a play yard frame according to another embodiment of the present invention.

FIG. 32 illustrates a play yard frame 500 according to one embodiment. According to various embodiments, the frame 500 includes the various features of the frame 100 described above, but does not include those relating to the retention members 108. For example, in the illustrated embodiment, the frame 500 includes a plurality of upper horizontal frame members 502, a plurality of lower horizontal frame members 504, and four vertical frame members 506. As shown, the upper horizontal frame members 502 are connected at the corners of the frame 500 to upper connecting members 515.

According to various embodiments, the upper connecting members 515 are configured to be selectively secured to upper ends of the vertical frame members 506. For example, in one embodiment, the upper connecting members 515 include a fastening device controlled by a latch or button permitting a user to selectively lock or unlock the various upper connecting members 515 to the vertical frame members 506. As such, by unlocking the upper connecting members 515 from the vertical frame members 506, a user may easily remove all of the upper horizontal frame members 502 from the frame 500.

In various embodiments, the frame 500 is configured to receive a play yard liner substantially similar to the liner 200 described above. For example, in one embodiment the liner may include sleeves dimensioned to slide over the vertical frame members 506. In such an embodiment, a user may remove the upper horizontal frame members 502 from the frame 500, slide the liner sleeves over the vertical frame members 506, and further secure the liner to the frame 500 using any suitable method described herein in relation to the frame 100 and liner 200. As noted above, the frame 500 and its respective liner may include various other aspects of the frame 100 and liner 200 described above. For example, the frame 500 may be configured to collapse in the manner of the frame 100. In addition, in other embodiments, the frame 500 may include a single, unitary upper horizontal frame member.

Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A children's play yard comprising:

a play yard frame comprising:

one or more lower horizontal frame members;

one or more vertical frame members extending upwardly from the one or more lower horizontal frame members;

one or more upper connecting members secured to upper ends of the one or more vertical frame members; and one or more upper horizontal frame members secured to the one or more upper connecting members; and a removable play yard liner configured for being removably secured to the play yard frame, wherein, when the removable play yard liner is secured to the play yard frame, the removable play yard liner is configured to extend over and cover at least one of the upper connecting members;

wherein at least one of the vertical frame members includes at least one mating fastener positioned at a height below and spaced from the at least one vertical frame member's respective upper connecting member, and wherein the removable play yard liner includes at least one fastener configured for engaging the at least one mating fastener to secure the removable play yard liner over the at least one vertical frame member's respective upper connecting member.

2. The children's play yard of claim 1, wherein the at least one fastener is disposed adjacent an outer edge of the removable play yard liner.

3. The children's play yard of claim 1, wherein the at least one mating fastener is disposed on an outer side edge of the at least one of the one or more vertical frame members.

4. The children's play yard of claim 1, wherein one of the at least one fastener and the at least one mating fastener comprises a fastening member defining a rigid protrusion and the other of the at least one fastener and the at least one mating fastener comprises a receiving member defining a cavity configured for receiving the rigid protrusion.

5. The children's play yard of claim 1, wherein at least one of the at least one fastener and the at least one mating fastener comprises a hook and loop type strap.

6. The children's play yard of claim 1, wherein, when the removable play yard liner is secured to the play yard frame, the removable play yard liner is configured to extend over upper portions of at least two of the one or more upper horizontal frame members and extend over an outer side portion of the at least one of the one or more vertical frame members.

7. The children's play yard of claim 1, wherein:

the one or more lower horizontal frame members comprise four lower horizontal frame members defining a four-sided lower perimeter of the play yard frame;

the one or more vertical frame members comprise four vertical frame members extending upwardly from corner portions of the four-sided lower perimeter of the play yard frame;

the one or more upper connecting members comprise four upper connecting members each secured to an upper end of one of the four vertical frame members;

the one or more upper horizontal frame members comprise four upper horizontal frame members extending between the four upper connecting members and defining a four-sided upper perimeter of the play yard frame; and the removable play yard liner is configured such that, when the removable play yard liner is secured to the play yard frame, the removable play yard liner extends over and covers each of the four upper connecting members.

8. The children's play yard of claim 1, wherein, when the removable play yard liner is secured to the play yard frame, one or more sidewalls of the play yard liner define a bounded area within the play yard frame.

9. The children's play yard of claim 1, wherein the removable play yard liner is constructed from a flexible, machine-washable material.

10. The children's play yard of claim 1, wherein:

the removable play yard liner further comprises:

a floor panel; and one or more sidewalls that extend upwardly from a perimeter of the floor panel and surround the floor panel.

11. The children's play yard of claim 1, further comprising a removable mattress configured to fit within the play yard liner and configured to be supported by the one or more lower horizontal frame members.

12. A method for securing a removable play yard liner to a play yard frame, said method comprising:

setting up the play yard frame to have one or more lower horizontal frame members, one or more vertical frame members extending upwardly from the one or more lower horizontal frame members, one or more upper connecting members secured to upper ends of the one or more vertical frame members, and one or more upper horizontal frame members secured to the one or more upper connecting members; and securing the removable play yard liner to the play yard frame at least in part by:

positioning the removable play yard liner over at least one of the one or more upper connecting members; and engaging at least one fastener disposed on the removable play yard liner with at least one mating fastener disposed on at least one of the one or more vertical frame members at a height below and spaced from the at least one upper connecting member.

13. The method of claim 12, wherein the step of positioning the removable play yard liner further comprises positioning the removable play yard liner over upper portions of at least two of the one or more upper horizontal frame members and over an outer side portion of the at least one of the one or more vertical frame members.

14. The method of claim 12, wherein the step of positioning the removable play yard liner comprises positioning the removable play yard liner over each of the one or more upper horizontal frame members.

15. The method of claim 14, wherein:

the one or more lower horizontal frame members comprise four lower horizontal frame members defining a four-sided lower perimeter of the play yard frame;

the one or more vertical frame members comprise four vertical frame members extending upwardly from corner portions of the four-sided lower perimeter of the play yard frame;

the one or more upper connecting members comprise four upper connecting members each secured to an upper end of one of the four vertical frame members;

the one or more upper horizontal frame members comprise four upper horizontal frame members extending between the four upper connecting members and defining a four-sided upper perimeter of the play yard frame; and the step of positioning the removable play yard liner comprises positioning the removable play yard liner over each of the four upper connecting members.

16. The children's play yard of claim 12, wherein the step of securing the removable play yard liner to the play yard frame further comprises positioning one or more sidewalls of the play yard liner to define a bounded area within the play yard frame.

17. A children's play yard comprising:

a play yard frame comprising:

one or more lower horizontal frame members;

one or more vertical frame members extending upwardly from the one or more lower horizontal frame members; and one or more upper horizontal frame members operatively connected to the one or more vertical frame members; and a removable play yard liner configured for being removably secured to the play yard frame, wherein the removable play yard liner comprises:

one or more sidewalls defining an upper perimeter; and at least one flap panel extending outwardly from the upper perimeter of the one or more sidewalls, wherein the at least one flap panel is configured for extending over the one or more upper horizontal frame members when the removable play yard liner is secured to the play yard frame and wherein the at least one flap panel defines one or more corner portions, the one or more corner portions extending outwardly a distance from the upper perimeter of the one or more sidewalls that is greater than one or more non-corner portions of the at least one flap panel.

18. The children's play yard of claim 17, wherein the at least one flap panel defines a curved outer edge.

19. The children's play yard of claim 17, wherein the play yard frame further comprises one or more upper connecting members secured to upper ends of the one or more vertical frame members;

wherein the one or more upper horizontal frame members are secured to the one or more upper connecting members; and wherein the at least one flap panel is configured for extending over the one or more upper connecting members when the removable play yard liner is secured to the play yard frame.

20. The children's play yard claim 17, wherein the one or more corner portions of the at least one flap panel are each configured to extend over and cover a portion of the play yard frame at which at least one of the one or more upper horizontal frame members is joined to at least one of the one or more vertical frame members.

* * * * *